United States Patent [19]

Frantz et al.

[11] Patent Number: 4,960,388

[45] Date of Patent: Oct. 2, 1990

[54] CIRCULAR CROSS SECTION DIN CONNECTOR AND DIN CONNECTOR ASSEMBLY

[75] Inventors: Robert H. Frantz, Newville; Benjamin H. Mosser, III, Middletown; Earl C. Myers, Jr., Harrisburg; Charles E. Reynolds, Mechanicsburg, all of Pa.

[73] Assignee: AMP Incorporated, Harrisburg, Pa.

[21] Appl. No.: 453,534

[22] Filed: Dec. 20, 1989

[51] Int. Cl.[5] ..... H01R 13/00

[52] U.S. Cl. ..... 439/404; 439/474; 439/610

[58] Field of Search ..... 439/389–426, 439/449, 470, 474, 607, 610

[56] References Cited

U.S. PATENT DOCUMENTS

| | | | |
|---|---|---|---|
| Re. 32,864 | 2/1989 | Ezure | 439/152 |
| 3,141,717 | 8/1959 | Olsson et al. | 339/66 |
| 4,310,213 | 1/1982 | Fetterolf, Sr. | 339/103 M |
| 4,316,647 | 2/1982 | Bailey et al. | 339/91 R |
| 4,611,878 | 9/1986 | Hall et al. | 339/186 M |
| 4,634,208 | 1/1987 | Hall et al. | 339/143 R |
| 4,723,916 | 2/1988 | Fusselman et al. | 439/92 |
| 4,737,124 | 4/1988 | Ezureet al. | 439/610 |

*Primary Examiner*—Joseph H. McGlynn
*Attorney, Agent, or Firm*—David L. Smith

[57] ABSTRACT

A circular cross section DIN connector comprises, a wire housing (10), a contact housing (12) and a shielding shell (14). The wire housing (10) has a through bore (16) for receiving an end portion of a shielded electrical cable (C) with wires thereof dressed into notches (32) at one end (30) of the wire housing (10) and extending over slots (34) in the bases (33) of the notches (32). The housings (10 and 12) are mated so that insulation displacement portions (64) of contact elements (42) of the contact housing (12) enter the slots (34) to make electrical contact with the cores of the wires (W). The mated housings (10 and 12) are received in the shell (14) which completely surrounds them. Parts (90) of the shell (14) are crimped down to engage the shielding braid (BS) of the cable (C) and firmly to retain the sub-assembly comprising the mated housings (10 and 12) in the shell (14) which is preferably a seamless drawn shell.

14 Claims, 22 Drawing Sheets

70
44
54
70
38
12
56
54
48
52
52
42c
60
42a
60
42d
68c
68a
68a
68a
68d
42b
60
62
62
64
64
64
64
62
60
66
66
66
42b
68b
42a
68b
62
68a
10
34
32
34
23
28
24
32
23
28
24
22
28
24
26

CIRCULAR CROSS SECTION DIN CONNECTOR AND DIN CONNECTOR ASSEMBLY

BACKGROUND OF THE INVENTION

This invention relates to a circular cross section electrical connector assembly and to a circular cross section electrical connector, and particularly to a miniature circular DIN plug assembly and connector, for shielded cable and comprising a shielding shell which affords full shielding for the assembled connector and which can safely be provided with a molded-on plastics cover.

BACKGROUND OF THE INVENTION

There is disclosed in US-A-4,733,916 a circular cross section plug and socket connector comprising a wire housing having a through axial bore from which extends radially a plurality of grooves insulated wires of a shielded cable are received through the bore and are located in the grooves, the grooves have slots associated therewith for receiving slotted wire connecting portions of contact elements supported by a mating contact housing. A tubular, open ended metal shielding shell which surrounds the contact housing but not the wire housing is connected to the cable shielding by means of a contact fork which engages a drain wire connected to said shielding. The shell is retained in the contact housing by means of a land on that housing which engages in a window in the shell. The wire hosing and the contact housing are maintained in mated relationship by means of a preformed plastic boot which is slipped thereover.

SUMMARY OF THE INVENTION

According to the present invention, the wire housing and the contact housing are both surrounded by a metal shell which is crimped at one end over the adjacent end of the wire housing as to engage the shielding of the shielded cable. Thus the whole sub-assembly comprising the two housings is completely shielded, the shell is connected directly to the cable shielding over a substantial area of contact and the shield and the crimped connection can be safely provided with an overmolded cover, for example for use as an insulating handle, without any substantial ingress of the molding material into the sub-assembly. For absolute security in providing a cover, the shell is preferably a seamless drawn item, the appropriate end portion of which is indented so as snugly to surround the cable braid at the entrance to the bore in the wire housing.

The shielding shell may define an internal peripheral shoulder which cooperates with an external shoulder on the said sub-assembly to retain it in the shell, in cooperation with the crimped joint thereof. The two housings are, therefore, firmly and non-releasably secured in the shell prior to the molding operation. Keying means on the shell and the said sub-assembly are preferably provided for correctly relatively orienting them angularly.

For guiding a cable end portion into the bore of the wire housing, the bore is preferably provided with an outwardly flared mouth.

The two housings may be guided into mating relationship so that they are secured together prior to the assembly of the shell thereto, by means of a hood on the contact housing, which receives the wire housing, the hood abutting a collar on the wire housing when the housings have been fully mated.

The hood and the wire housing may conveniently be formed with half channels which cooperate to enclose end portion of the wires so that the wires cannot be grounded by reason of their ends accidentally touching the interior of the shielding shell.

DESCRIPTION OF THE PREFERRED EMBODIMENT

Figure 1:
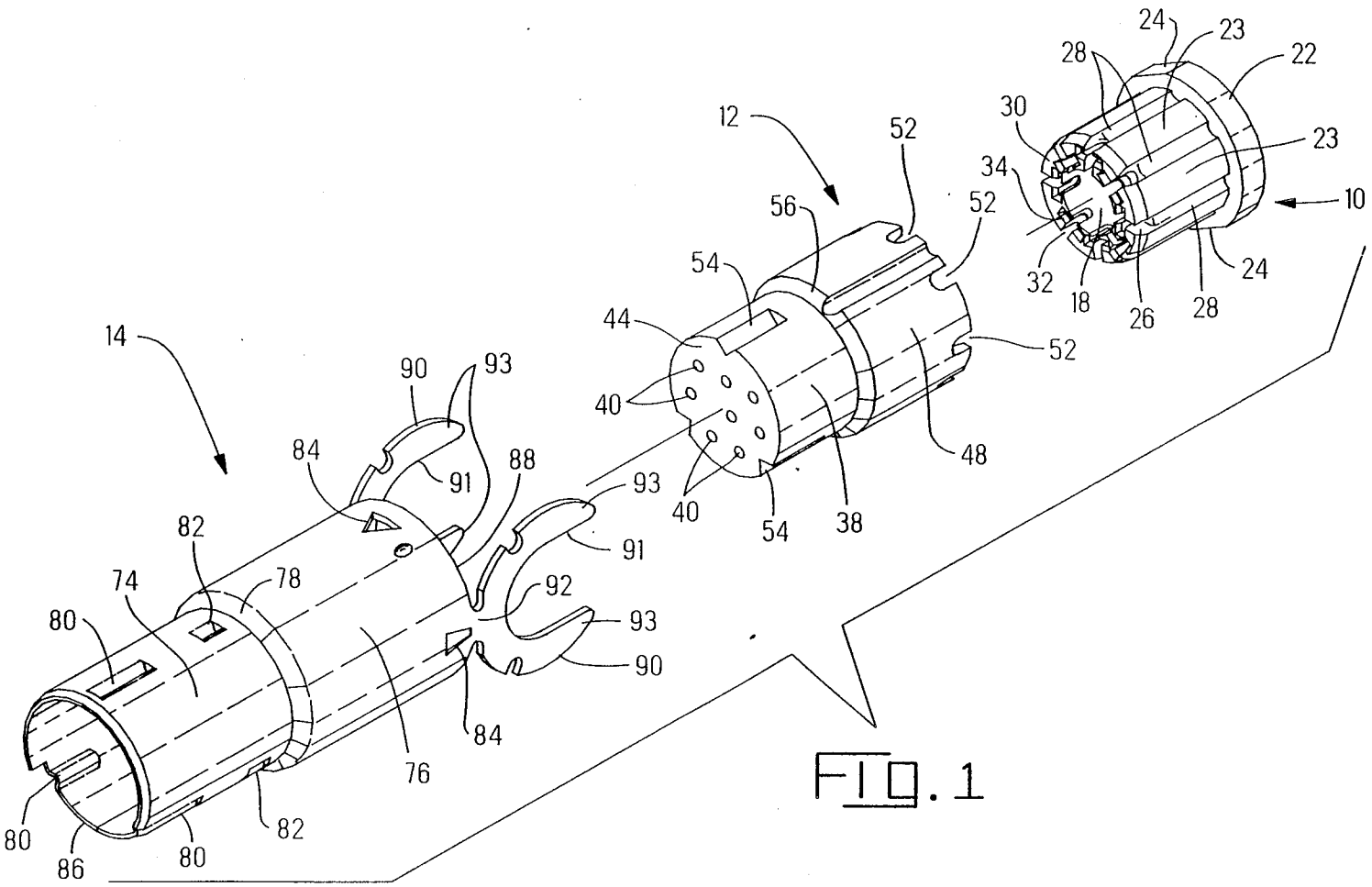
FIG. 1 is an enlarged isometric, exploded view of a miniature circular DIN plug assembly according to an embodiment of the invention, comprising a wire housing, a contact housing and a shielding shell.
Figure 2:
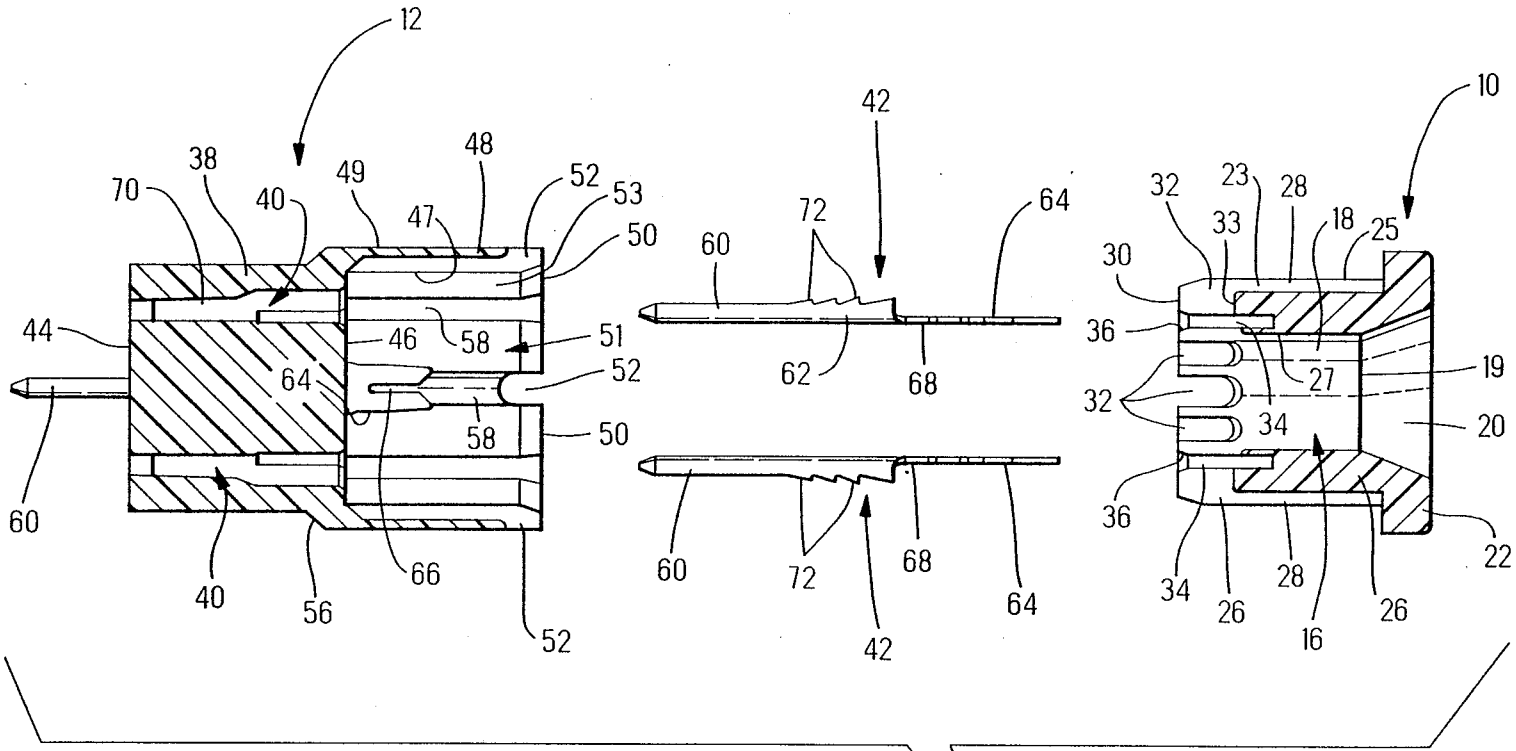
FIG. 2 is an enlarged exploded view, in longitudinal section, showing the wire housing, the contact housing and contact elements thereof.

An eight position DIN circular cross section plug assembly and the manner in which its components are assembled to a multi wire shielded cable will now be described with reference to FIGS. 1 to 9. As shown in FIG. 1, the assembly comprises three components, an insulating, wire housing 10, an insulating, contact housing 12, and a metal shielding shell 14. The wire housing 10, is tubular, defining the bore 16 which is of circular cross section, having a substantially constant cross section, forward, wire receiving part 18 opening into a rearward cable end receiving, rearwardly flared, guide mouth 20, as best seen in FIG. 2. The bore parts 18 and 20 co-operate to define a stop shoulder 19. The mouth 20 is surrounded by a rearward, collar 22 formed with opposed flats 24 but being otherwise of circular cross section. The wire receiving part 18 of bore 16 is defined by a circular wall 26 extending normally of collar 22. The inner surface 27 defines bore 16. Outer surface 25 is formed with eight parallel, wire receiving grooves 28 substantially equally spaced around the periphery of wall 26. Grooves 28 open into a mating forward end 30 of the housing 10. Each groove 28 intersects and communicates with a respective transverse radially extending wire receiving notch 32 which defines base 33 in forward end 30. Grooves 28 thus communicate with wire receiving part 18 of bore 16. In line with each notch 32 and extending through base 33 and the sides thereof, wall 26 is formed with a slot 34 for receiving a wire connecting portion of a contact element secured in housing 12. Each slot 34 has a flared, guiding mouth 36 opening into the mating face 30.

The contact housing 12 comprises a substantially cylindrical dielectric block 38 formed with eight contact element-receiving, through cavities 40, the configurations of some of which differ from one another, as described in detail below, each for receiving the electrical contact element 42, some of which also differ from one another, as described in detail below. Each cavity 40 opens at one end, into a forward mating face 44 of the block 38 and into a rear mating face 46 thereof. The face 46 has projecting rearwardly therefrom, a cylindrical hood 48 surrounding the face 46 defining concentric cylindrical inner wall 47 and outer wall 49. Within inner wall 47 is cylindrical cavity 51 sized to receive the wiring housing 10. Hood 48 extends to rearward edge 50 into which open eight radially extending wire receiving notches 52. The block 38 is also formed with three keyways 54 which open into the face 44. The keyways cooperate with structure on a mating connector to assure proper orientation prior to mating. The hood 48, which is of somewhat larger diameter than block 38, defines an inclined peripheral stop surface 56 extending thereabout. The internal surface of the hood 48 is formed with parallel, wire receiving grooves 58 each extending from the rear face 46 of block 38 and opening into a respective notch 52. Grooves 58 are recessed into inner wall 47 parallel to the axis of cylindrical block 38 and spaced around the periphery of inner wall 47 to correspond to the spacing of grooves 28 around the wire housing. In the preferred embodiment, grooves 58 are substantially equally spaced around the periphery.

Outer surface 25 of wire housing 10 between adjacent grooves 28 form ribs 23 to engage the inner wall 47 of contact housing 12. Ribs 23 position wire housing 10 transverse to the axis within cavity 51 in contact housing 12. Radially inwardly directed ribs 23 also provide a space between the wire housing and the contact housing to receive the ends of conductors.

Hood 48 has between adjacent grooves 58 radially outwardly directed rib means 53 to engage either ribs 23 or outer surface 25, whichever is present, of wire housing 10 to position wire housing 10 transverse to the axis within cavity 51 in contact housing 12. Ribs 53 provide a space between the wiring housing and the contact housing to receive the ends of conductors.

Grooves 28 and 58 are each recessed into cylindrical surfaces. Each groove receives a chordal cross section of a wire W. Typically neither groove 28 nor groove 58 of a pair of cooperating grooves receives more than about half of the cross section of a wire W received therein. A pair of grooves 28 and 58, in the preferred embodiment, cooperate to provide a wire receiving channel.

Figure 3:
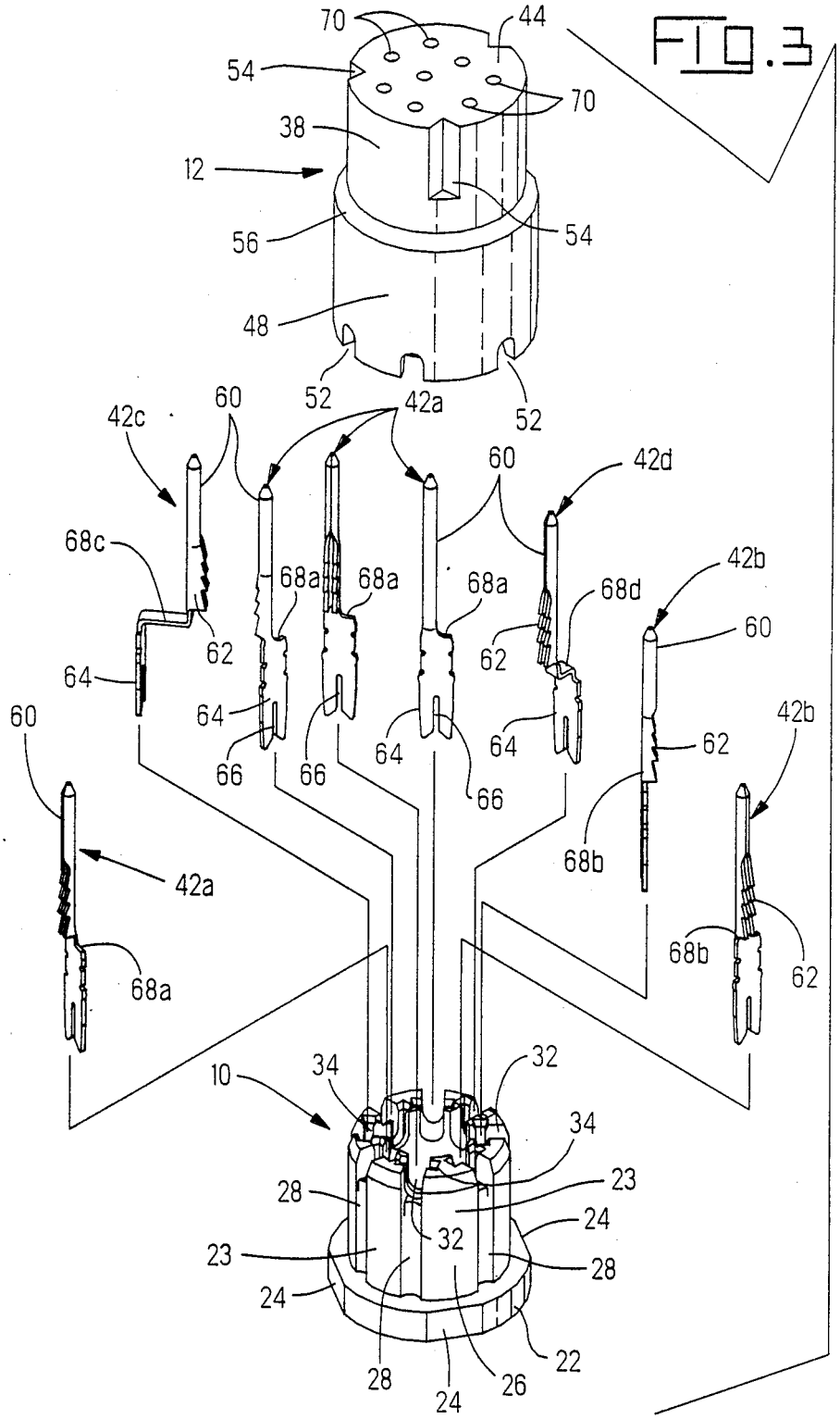
FIG. 3 is an enlarged isometric exploded view showing the said housings and contact elements.

Each contact element 42 comprises a mating portion in the form of a pin 60, a serrated anchoring portion 62 and a wire connecting portion 64 having a wire receiving slot 66, the wire connecting portion 64 being connected to the anchoring portion 62 by way of a transition portion 68. The transition portion 68 of some of the contact elements 42 are differently configured as shown in FIG. 3, for reasons explained below.

Figure 4:
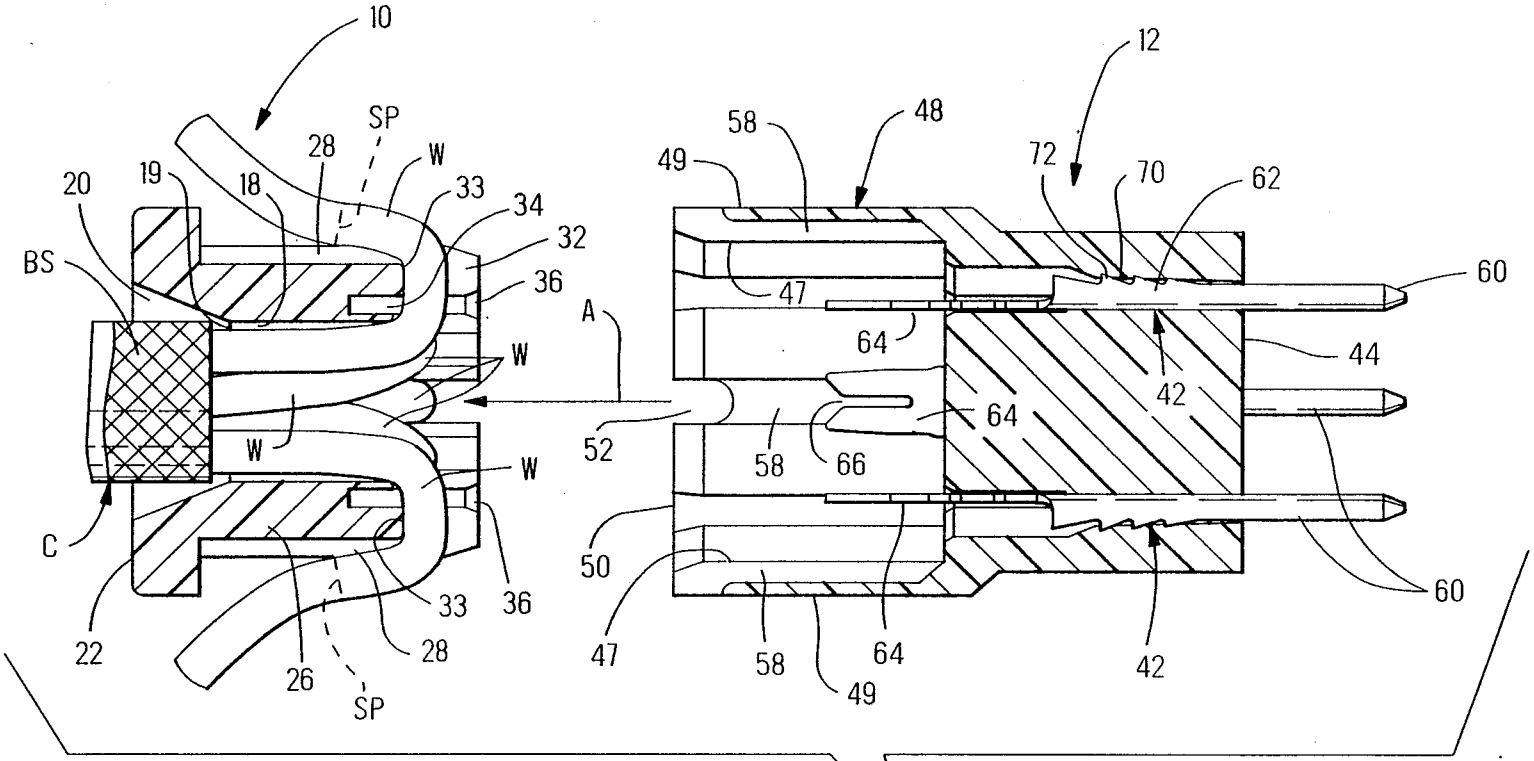
FIG. 4 is an enlarged longitudinal sectional view illustrating how the contact housing is assembled to the wire housing when the latter has been loaded with wires of a shielded cable.

The housing 12 is loaded with the contact elements 42, by inserting each contact element 42 with its pin 60 leading, by way of the hood 48, into a respective cavity 40 so that, as shown in FIG. 4, the anchoring portion 62 of each contact element 42 and the rear part of the pin 60 thereof are received in a constricted portion 70 of the respective cavity 40. Serrations 72 on the portion 62 bite into the walls of the cavity portion 70 in block 38 thereby to retain the contact element 42 therein, with the pin 60 thereof projecting from the mating face 44 of the block 38 and the wire connecting portion 64 of the contact element 42 projecting from the mating face 46 of the block 38.

The shielding shell 14 is tubular and is of circular cross section and comprises a smaller cross section forward part 74 and a larger cross section rear part 76 defining a stop shoulder 78 which is complimentary with the shoulder 56 of the housing 12. The part 74 is formed with internal longitudinal forward keys 80 and with shorter internal rear keys 82, each in line with a respective key 80, the part 76 being formed rearwardly thereof with internal keys 84 each in line with a pair of respective keys 80 and 82. The shell 14 has a forward edge 86 and rear edge 88. There project from the rear edge 88, a pair of opposed crimping lugs 90 of substantially semi-circular shape and being connected to the edge 88 by way of necks 92, the lugs 90 having braid engaging inner edges 91.

In order to load the wire housing 10 with wires, an end portion of a shielded, multiwire electrical cable C is stripped to expose the insulated wires W thereof, which in the present example, are eight in number, as well as an end portion of the metallic braid shield BS of the cable C, which shield BS is then folded back. The wires W are inserted through the bore part 18, guided by the mouth 20, until the jacket and shield abut against stop shoulder 19. The wires W are then laced into respective radial notches 32, to lie on the bases 33 thereof so as to be dressed over the slots 34, as shown in FIG. 4. The contact housing 12 loaded with contact elements 42 as described above, axially aligned with wire housing 10, then one or both of the housings are moved toward each other until mated, such as moving housing 10 in the direction of the arrow A in FIG. 4 so that the wall 26 of the housing 10 is received in the hood 48 of the housing 12. The relative movement of the wire housing and contact housing effects termination of conductors of cable C to respective contact elements. The wire connecting portion 64 of each contact element 42 enters a respective slot 34 in the wall 26 guided by the mouth 36 of the slot 34 so that the portion of each wire extending across the slot 34 is received in the wire receiving slot 66 of a respective wire connecting portion 64 whereby the edges of the slot 66 displace the insulation of the wire W so as to make permanent conductive contact with the metal core of the wire W. Each wire W is sheared off at a shear plane SP before the wire W is engaged by the respective wire connecting portion 64. As the housings 10 and 12 are being mated, the walls of the grooves 58 of the housing 12 force those parts of the wires W which lie outwardly of outer surface 25 of wall 26, into the grooves 28, whereby the half channels defined by the grooves 28 and 58 co-operate to enclose said parts of the wires, so that their sheared ends lie facing the collar 22. Part of the folded back end part of the shield BS lies in the flared mouth 20.

Figure 5:
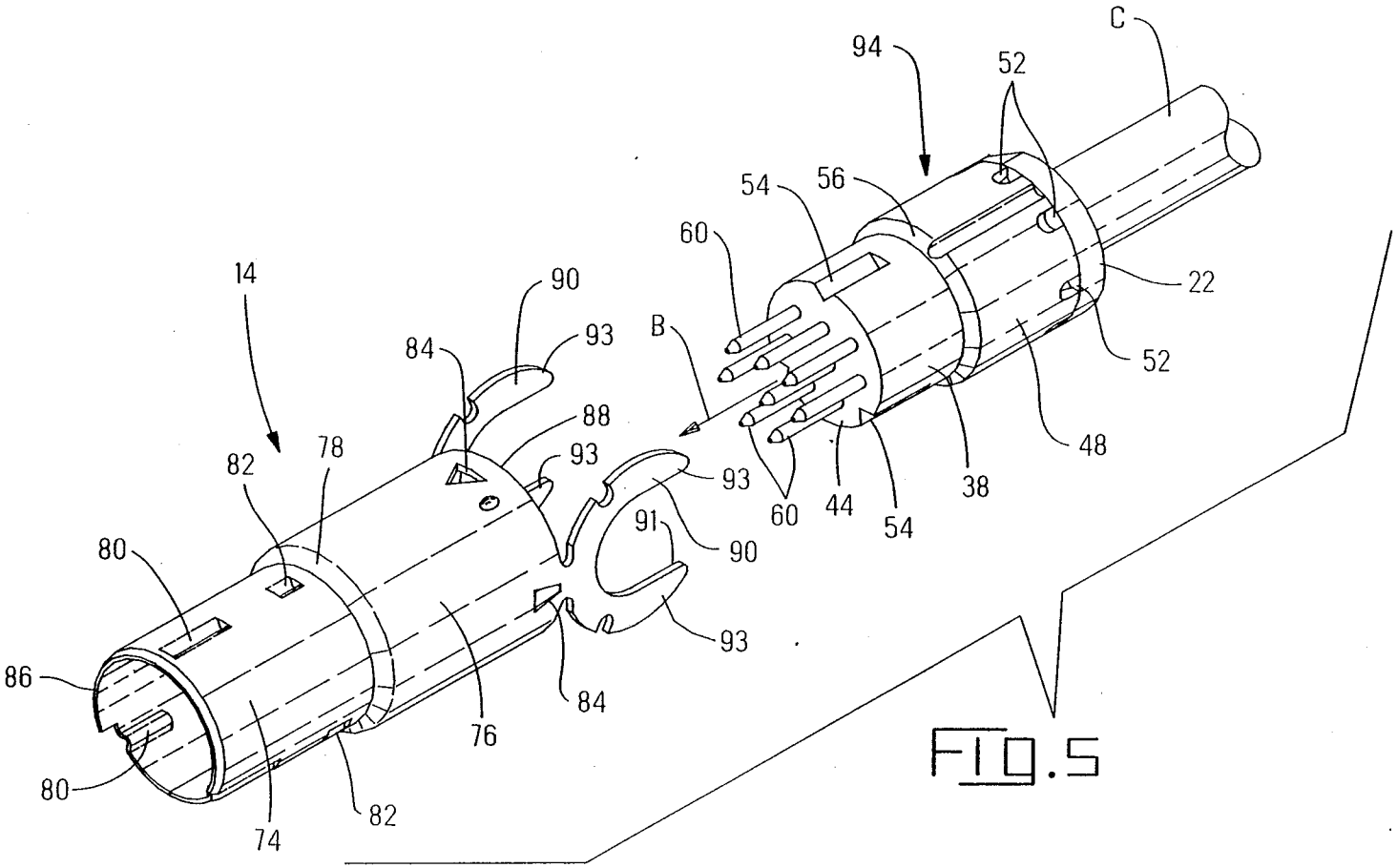
FIG. 5 is an enlarged isometric view illustrating a step in the assembly of the wire and socket housings to the shielding shell.
Figure 6:
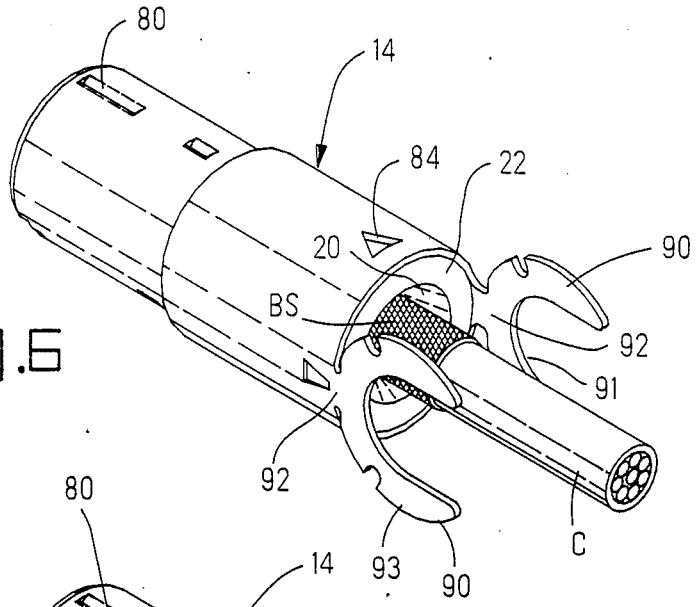
FIG. 6 is an enlarged isometric rear view of the shielding shell with the housings inserted thereinto.
Figure 7:
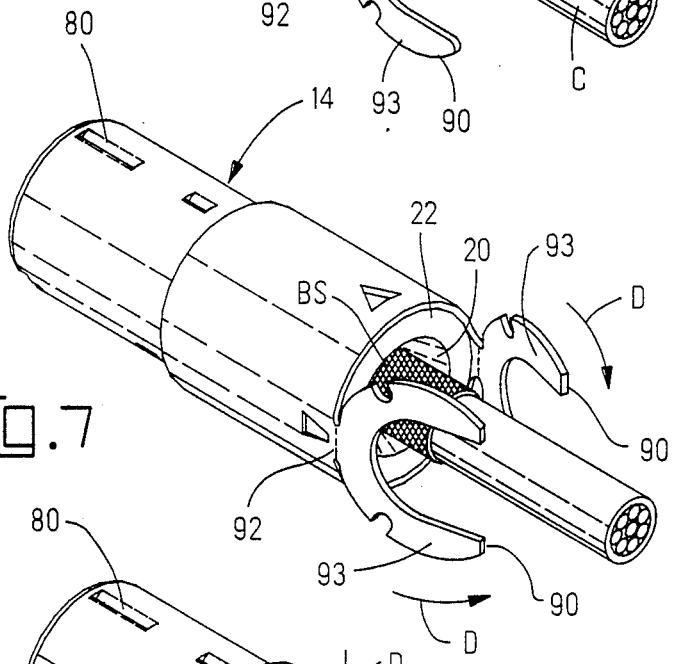
FIGS. 7 and 8 are enlarged, fragmentary rear views illustrating a further step in the assembly of the housings to the shielding shell.
Figure 8:
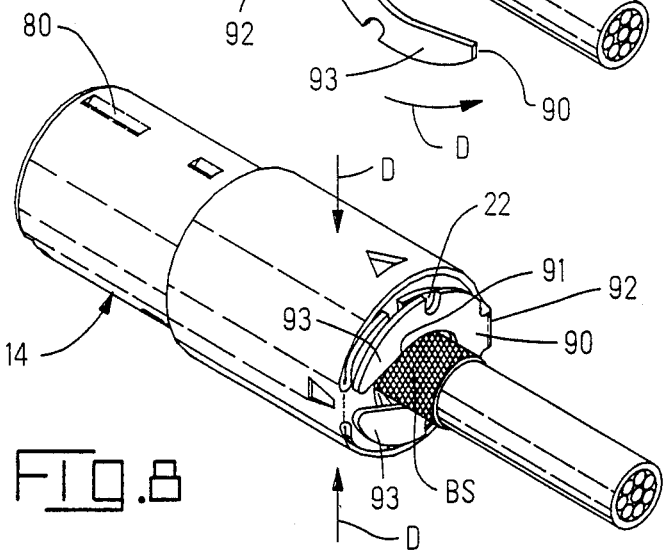
Figure 9:
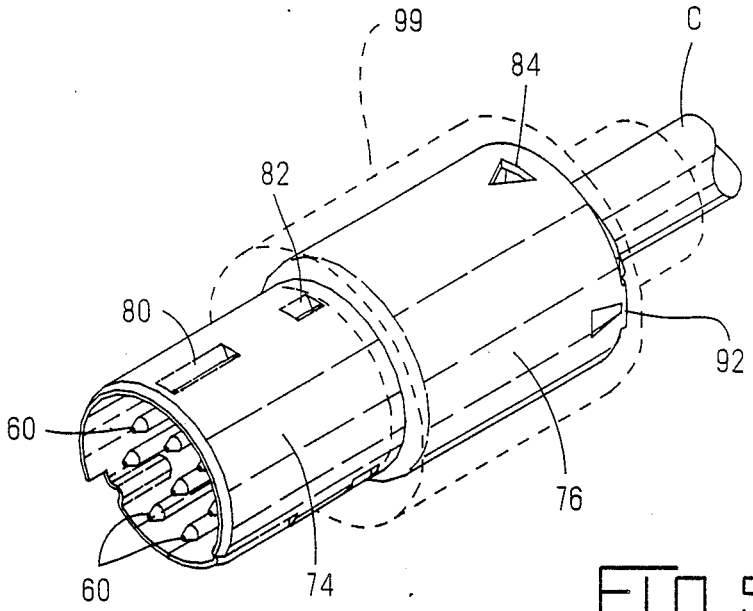
FIG. 9 is an enlarged isometric, frontal view showing the miniature DIN plug assembly in its fully assembled state.

The sub-assembly 94 provided by the assembled housings 10 and 12, is now axially aligned with the shell 14, as shown in FIG. 5, with the face 44 of the housing 12 directed towards the edge 88 of the shell 14. Shell 14 is typically stamped and formed. The sub-assembly 94 is so angularly oriented with respect to the shell 14, that each keyway 54 of the former, is aligned with the aligned keys 82 and 84 of the latter. The sub-assembly 94 is then inserted into the shell 14 guided by co-operation between the keys 54 and the keyways 82 and 84 until the stop shoulders 56 and 78 are in abutment. In this fully seated or mated position of the sub-assembly 94 and the shell 14, which is shown in FIG. 6, the lugs 90 are crimped over, as indicated by the arrows D in FIGS. 7 and 8 so that they engage the collar 22, ends 93 of each lug 90 are pressed toward each other such that inner edges 91 of the lugs 90 firmly engage the braid shield BS of the cable C making electrical and mechanical contact therewith and providing strain relief. The sub-assembly 94 is thus secured within the shell 14, against all movement with respect thereto, by virtue of the cooperation between the said keys and keyways, the abutment shoulders 56 and 78, the lugs 90 and the collar 22, the shell 14 being electrically commoned with the braid shield BS by means of the lugs 90. The part of the folded back end of the shield BS, which projects beyond the lugs 90, is then severed. The completed miniature circular DIN plug assembly is shown in FIG. 9 with the pins 60 of the contact elements 42 projecting into the part 74 of the shell 14 for mating with sockets of a DIN socket assembly (not shown), having keyways for receiving the keys 80. Since the outer portions of the wires W are snugly enclosed by the walls of the grooves 28 and 58, with the sheared ends of the wires W facing the collar 22, the wires W cannot be grounded by electrical connection with the shielding shell 14.

The assembly shown in FIG. 9 can, since it is fully surrounded by the shell 14, safely be encapsulated to provide an overmolded insulating handle 99 (shown in phantom) covering the crimped connection for the plug assembly, since the encapsulating resin cannot to any significant extent reach the sub-assembly 24 in the shell 14.

Figure 33:
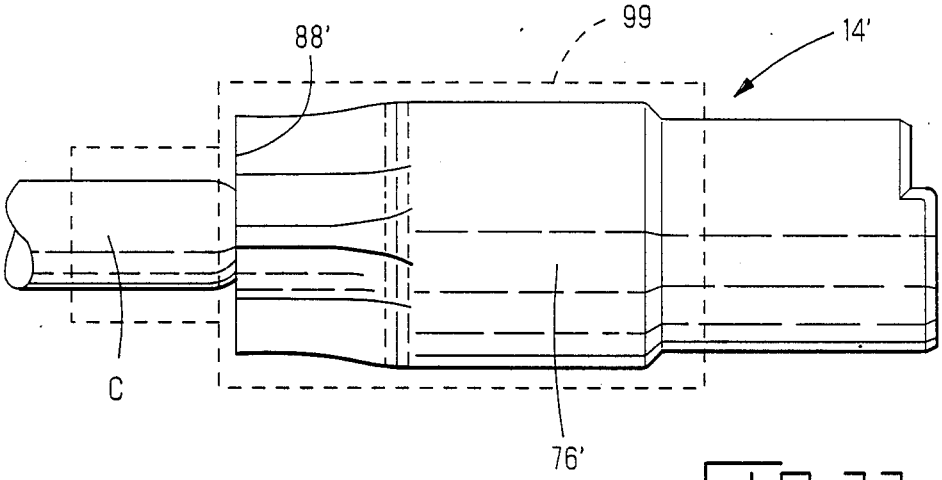
FIGS. 33 and 34 are an enlarged side view and an enlarged end view, respectively, of a miniature DIN plug assembly having an alternate embodiment shielding shell.
Figure 34:
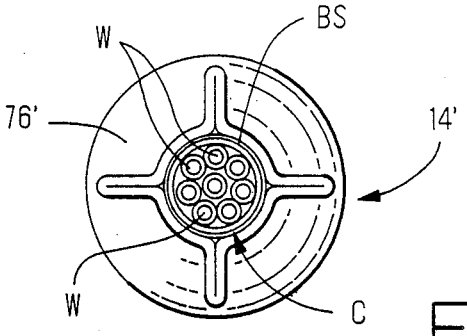

For absolute protection of the sub-assembly 94 against the encapsulating resin, the lugs 90 may be omitted from the shell 14', which is a seamless drawn shell, as shown in FIGS. 33 and 34 and the rear end portion of the part 76 thereof crimped firmly about the braid shield BS of the cable C by means of indenting tooling (not shown) providing a star shaped crimp, best seen in FIG. 34. The shell 14' is designed for crimping to multiple different diameters of cable to provide electrical continuity with the braid and strain relief to the cable.

Figure 27:
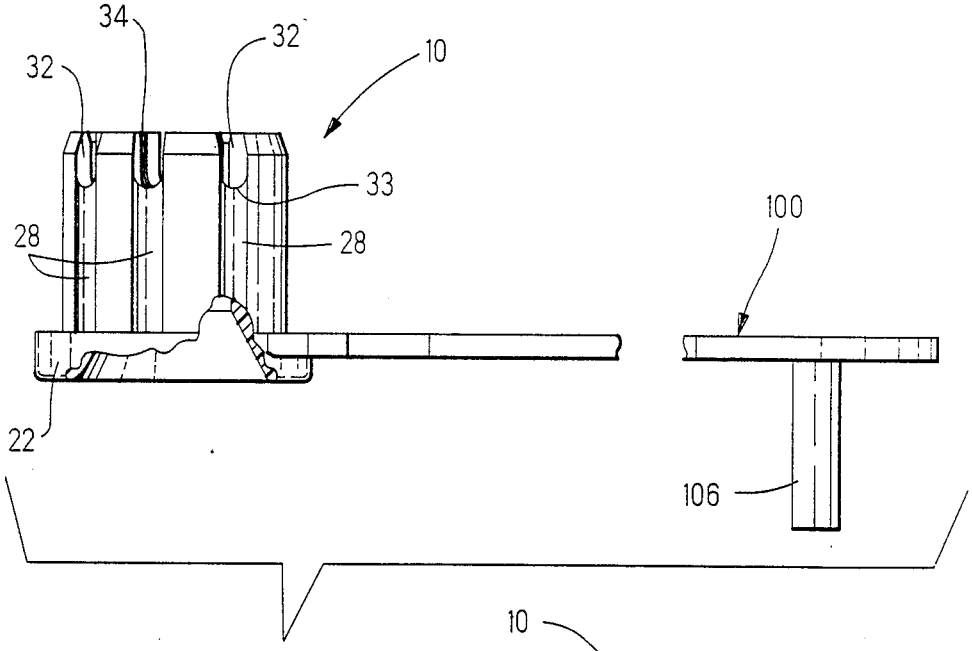
FIG. 27 is an enlarged side view, shown partly in section, of the wire housing.
Figure 28:
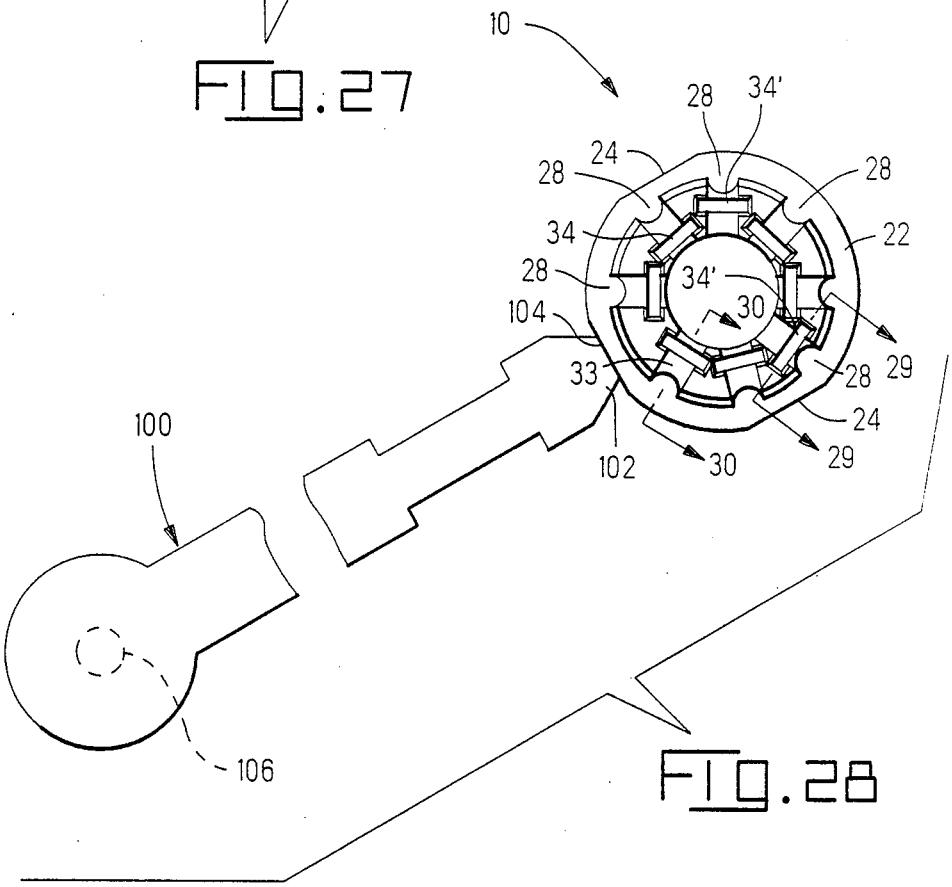
FIG. 28 is an enlarged top plan view of the wire housing.
Figure 29:
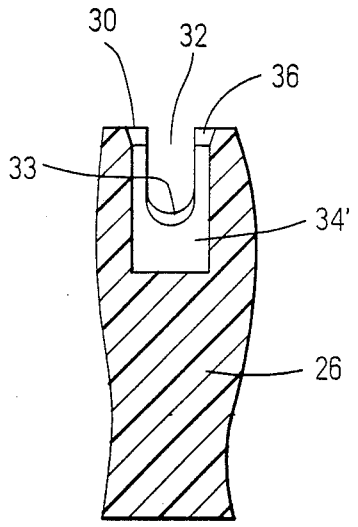
FIGS. 29 and 30 are views taken on the lines 29-29 and 30-30 respectively of FIG. 28.
Figure 30:
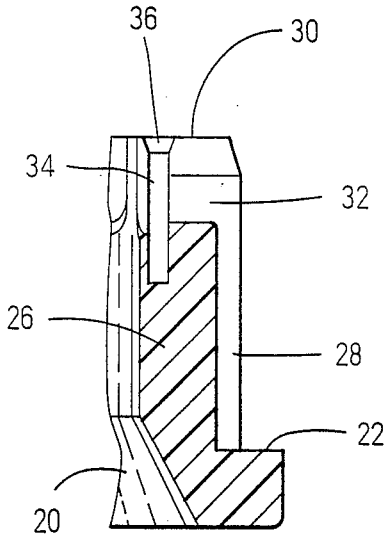

The wire housing 10 will now be described in greater detail with reference to FIGS. 27 to 30. As shown in FIGS. 27 and 28, the housing 10 is provided with a handling tab 100 parallel to the flats 24, to facilitate handling the housing 10 in a preferred method of assembling it to the housing 12, which is described in detail below. The tab 100 is connected to the collar 22 of the housing 10 by a reduced cross section portion 102 which is formed integrally with a further flat 104 on the collar 22 and which can be broken off therefrom at a position which is slightly inward of the arcuate outer periphery of the collar 22, by virtue of the flat 104. Proximate to its end opposite to the portion 102, the tab 100 has a depending leveling extension 106 projecting below the housing 10, as shown in FIG. 27. As shown in FIG. 28, the slots 44 are distributed about the center of the housing 10 inwardly of the outer surface 25 of the wall 26. Six of the slots 34 are equally spaced from the center of the housing 10 but two other slots, which are referenced 34' are spaced from the center of the housing 10 by a slightly greater distance. As best seen in FIGS. 29 and 30, notches 32 are of sufficient depth to enable the wires W to be dressed thereinto so that they do not protrude above mating face 30 of the housing 10, thereby ensuring that contact housing 12 will seat properly on the housing 10 when it is assembled thereto as described above.

Figure 10:
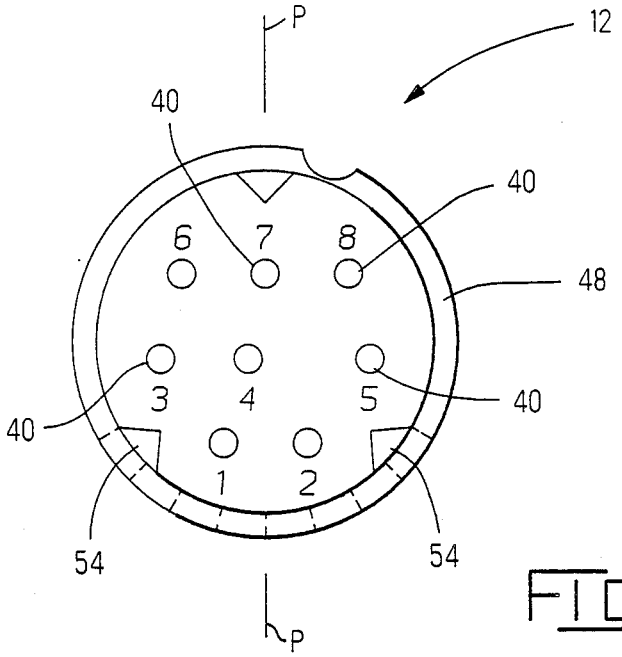
FIGS. 10, 11 and 12 are, an enlarged front end view, an enlarged side view, shown partly in section, and an enlarged rear end view, respectively, of the contact housing.
Figure 11:
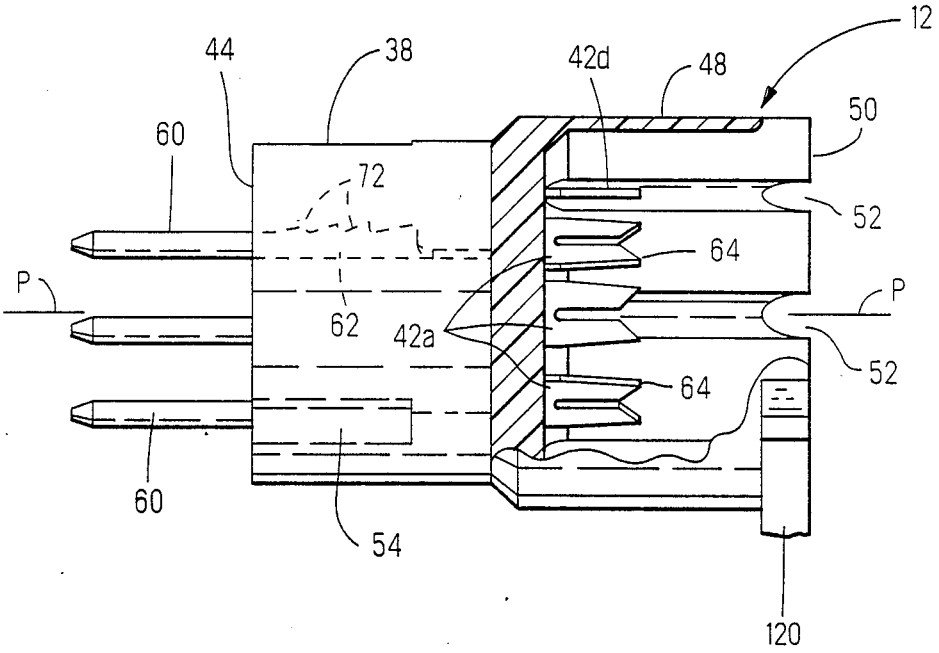
Figure 12:
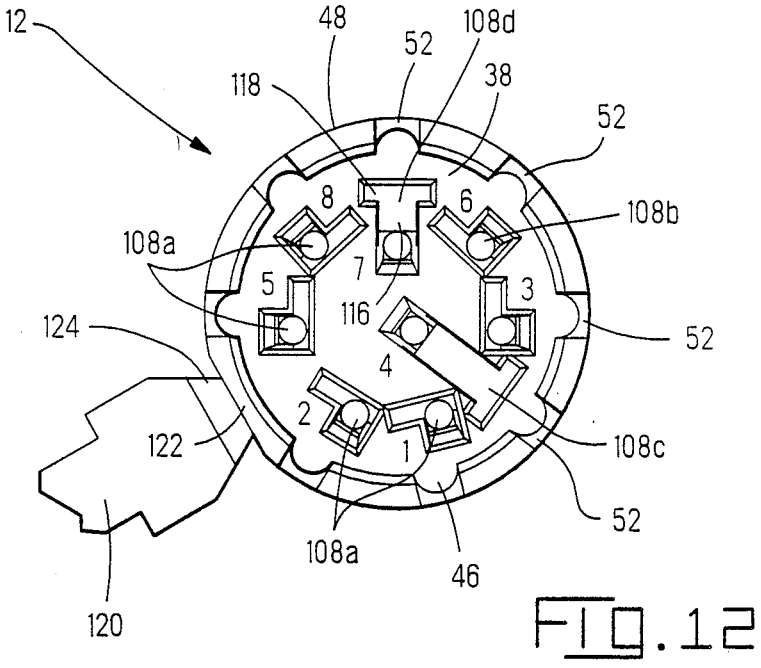
Figure 13:
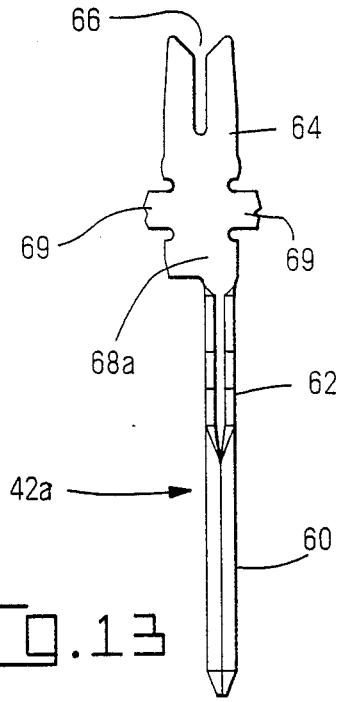
FIGS. 13 to 16 are enlarged elevational views of respective contact elements of the contact housing.
Figure 14:
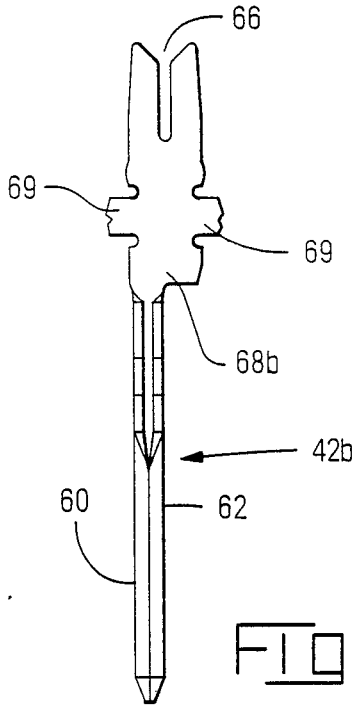
Figure 15:
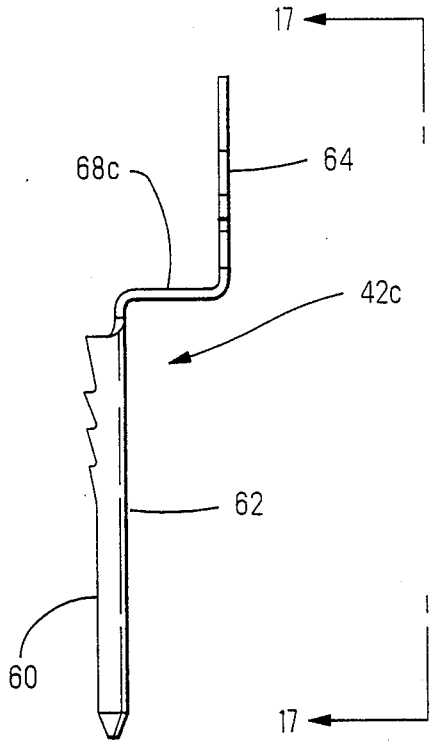
Figure 16:
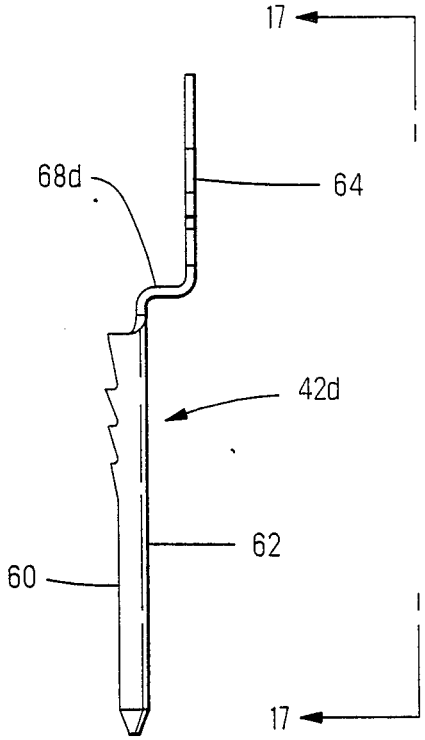
Figure 17:
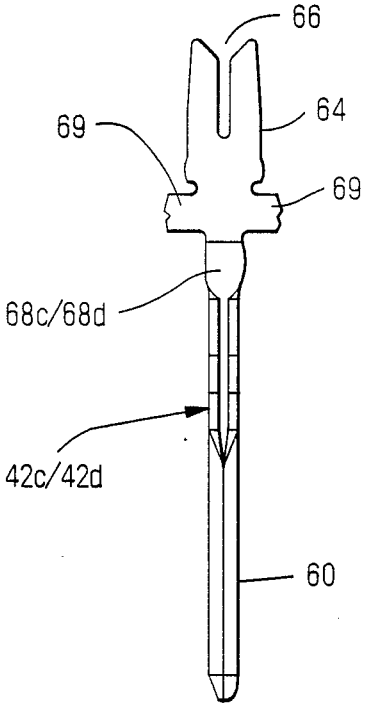
FIG. 17 is a view of either of the contact elements shown in FIGS. 15 and 16, taken in the direction of the arrow 17 in each of these FIGS.

The contact housing 12 will now be further described with reference to FIGS. 10 to 19. As shown in FIG. 10, the pins 60 of the contact elements 42 are, according to a DIN standard, required to be located at pre-determined positions with respect to the center of the housing 12 but not in the same array as the slots 34 and 34' of the housing 10 and to be closely spaced it will be apparent from FIG. 10 and 12 that the standard requires a high contact density. The contact positions are numbered 1 to 8 in FIGS. 10 and 12. Typically from three to eight positions receive contact elements. It will be apparent from a comparison of FIGS. 10 and 28, that each contact element must be configured so that its wire connecting portion 64 enters a respective slot 34 or 34' as the case may be when the housings 10 and 12 are mated, and to this end, rear portions **108*a*, 108*b*, 108*c* and 108*d* of the cavities 40 in the block 38, which portions receive the transition portions 68 of the contact elements 42, must be differently configured as shown in FIG. 12, the contact elements 42, which are referenced 42*a* to 42*d* in FIGS. 3 and 13 to 17, having differently configured transition portions 68 which are referenced 68*a* of the contact elements 42*a*, which are to be received in the cavities 40 at the positions 1, 2, 5, and 8, (see FIG. 10) are shaped to offset the wire connecting portion 64 of the contact element 42*a* laterally leftwardly from the pin 60 thereof, as shown in FIG. 13. The transition portions 68*b* of contact elements 42*b* for reception in the cavities 40 at the positions 3 and 6 are shaped to offset the wire connecting portion 64 from the pin 60 rightwardly as shown in FIG. 14. These offsets provide that the center of wire receiving slot 66 is laterally spaced from the axis of pin 60 in contact elements 42***a* and 42*b*. As shown in FIG. 15, the transition portion 68*c* of the contact element 42*c* for reception in the cavity 40 at position 4 is shaped to offset the wire connecting portion 64 of the contact element 42*c* from its pin 60 by a substantial distance rightwardly out of the plane of the pin 60, or equivalently pin 60 out of the plane of wire connection portion 64, since position 4 is spaced a commensurate distance inwardly of the periphery of the face 46 of the housing 12 shown in FIG. 12. As shown in FIG. 16, the transition portion 48*d* of the contact element 42*d* for reception in the cavity 40 at position 7 serves similarly to offset the wire connecting portion 64 of the contact element rightwardly of the plane of the pin 60, or equivalently pin 60 out of the plane of wire connecting portion 64, by a lesser distance than does the portion 68*c* of the contact element 42*c*, since position 7 is nearer to the periphery of the face 46 than position 4. FIG. 17 shows either of the contact elements 42*c* and 42*d* from a position at right angles to the plane the wire connecting portion 64. It will be apparent from the foregoing that contact elements 42*a* and 42*b* are coplanar whereas the contact elements 42*c* and 42*d* are not. Each contact element 42*a* to 42*d* is provided between its transition portion and its wire connecting portion 64, with a pair of locating wings 69.

Figure 18:
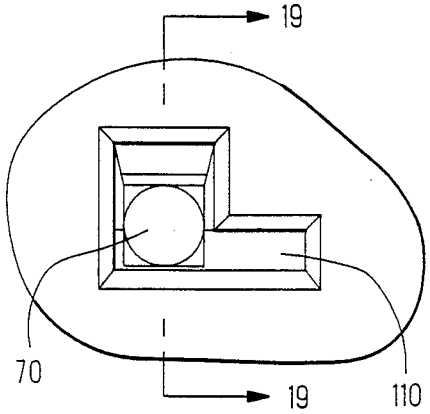
FIG. 18 is an enlarged top view of a contact element receiving cavity shown in FIG. 12.
Figure 19:
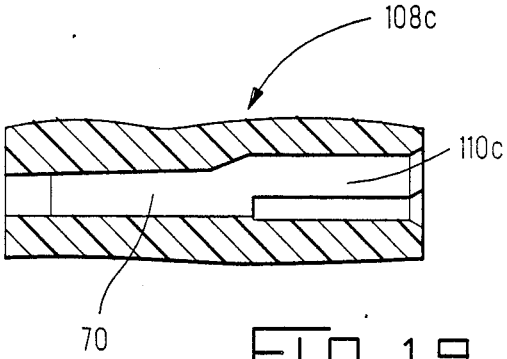
FIG. 19 is a view taken on the lines 19—19 of FIG. 18.

FIGS. 18 and 19 show one of the cavity portions 108*a* at positions 1, 2, 5 and 8. The cavity portions 108*b* at positions 3 and 6 are of the same shape as the cavity portions 108*a* but are oriented in mirror image relationship with respect thereto. Each cavity portion 108*a* and 108*b* comprises a slot 110 for the transition portion 68*a* or 68*b* as the case may be, and the locating wings 69.

Figure 20:
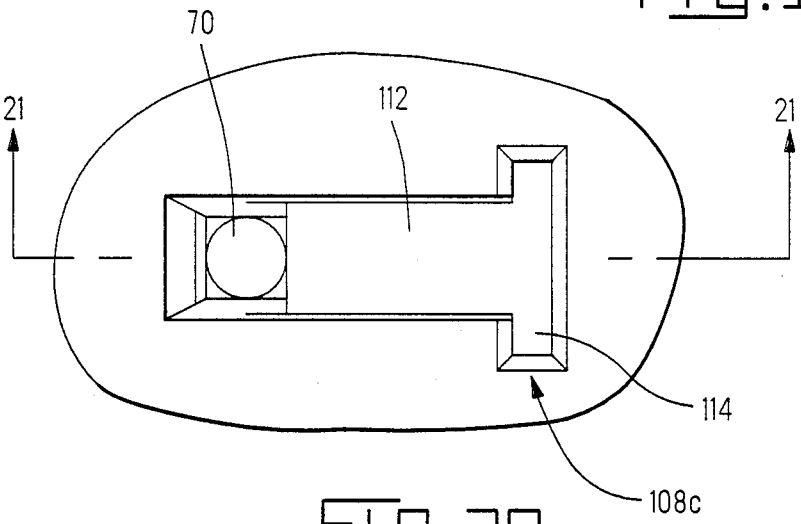
FIG. 20 is a top plan view of another contact element receiving cavity shown in FIG. 12.
Figure 21:
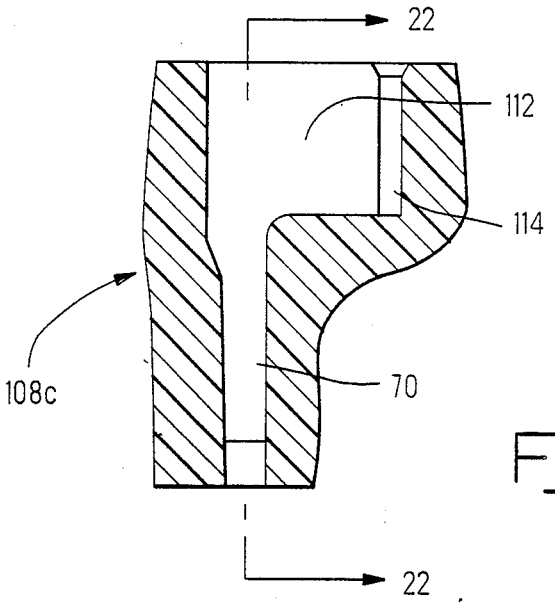
FIG. 21 is a view taken on the lines 21—21 of FIG. 20.
Figure 22:
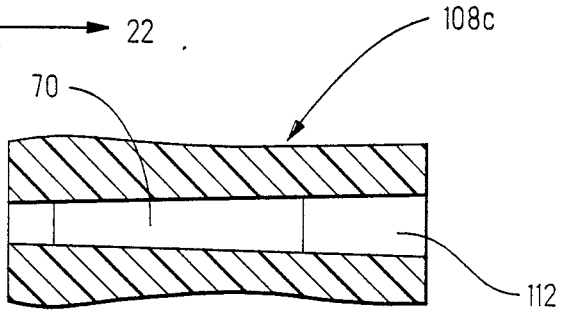
FIG. 22 is a view taken on the lines 22—22 of FIG. 21.

FIGS. 20 to 22 show the cavity portion 108*c* at position 4, which comprises an elongate slot 112 extending radially outwardly of the cavity portion 70, with which it communicates, for receiving the transition portion 68*c* of the contact element 42*c* and terminating in a transverse slot 114 extending normally of the slot 112 for receiving the locating wings 69 of that contact element. The cavity portion 108*d* (FIG. 12) is similar to the cavity portion 108*c* but has an elongate slot 116 which is shorter than the slot 112, for receiving the transition portion 68*d* of the contact element 42*d* and which terminates in a transverse slot 118 extending normally of the slot 116 for receiving the locating wings 69 of the contact element 42*d*.

As will be apparent from FIG. 12, the slots 110 of the cavity portion 108*a* and 108*b* at positions 3 and 5 extend parallel to a longitudinal central plane P-P (FIGS. 10 and 11) of the housing 12, the slots 110 of the cavity portions 108*a* and 108*b* at positions 6 and 8 being angled with respect to the plane P-P by 50°, and the slot 110 of the cavity portion 108*a* at position 2 being angled by 60° with respect to the plane P-P and the slot 110 of the cavity portion 108*a* at position 1 being angled by 70° with respect to the plane P-P. The slot 114 of the cavity portion 108*c* at position 4 is angled by 40° with respect to the plane P-P. The slot 118 of the cavity portion 108*d* at position 7 is angled by 90° with respect to the plane P-P. the slot 112 is angled by 50° with respect to the plane P-P and the slot 116 by 0° with respect thereto. The wire connecting portions 64 of the contact elements 42*a* to 42*d* at the positions mentioned above are angled with respect to the plane P-P in the same way as the respective transverse slots receiving the wings 69, so as to conform with the positioning of the respective slots 34 and 34' in the wall 26 of the wire housing 10.

For use in assembling the contact housing 12 to the housing 10, the housing 12 is provided with a handling tab 120 frangibly connected by way of a reduced cross-section portion 124, to a flat 122 adjacent to the edge 50 of the hood 48. The tab 120 is the same as the tab 100 excepting that it is not provided with a projecting spigot.

Figure 23:
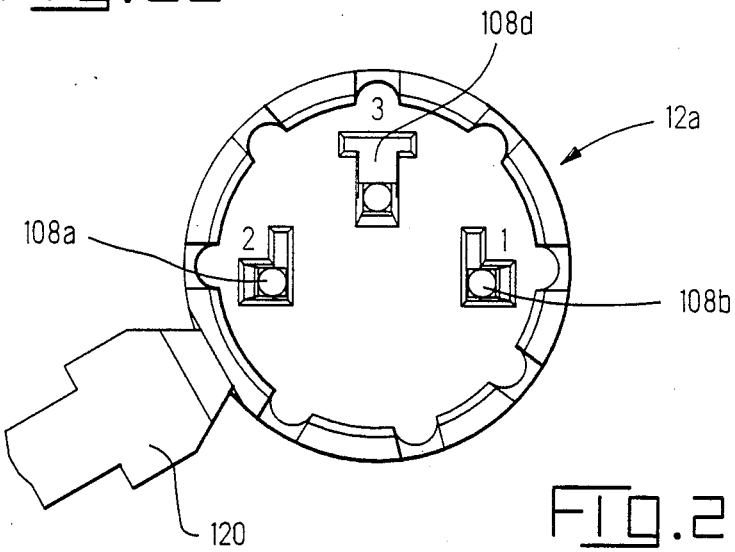
FIGS. 23 to 26 are enlarged rear end views of a three position, a four position, a five position, and a six position, contact housing, respectively.
Figure 24:
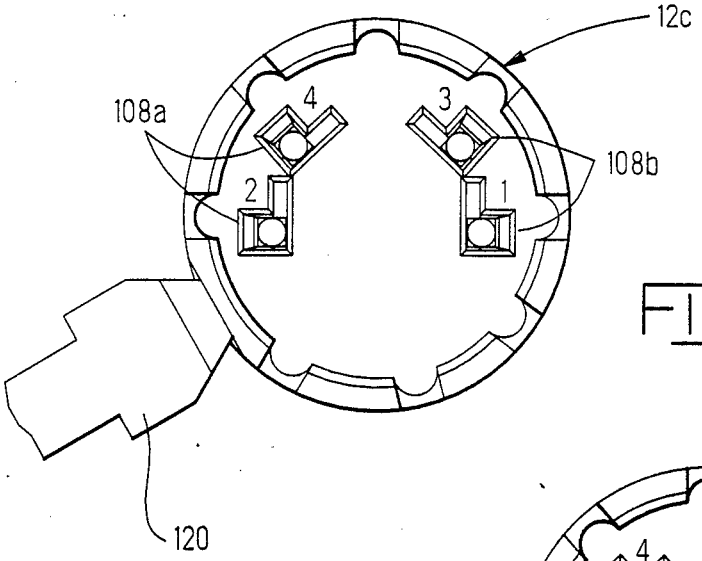
Figure 25:
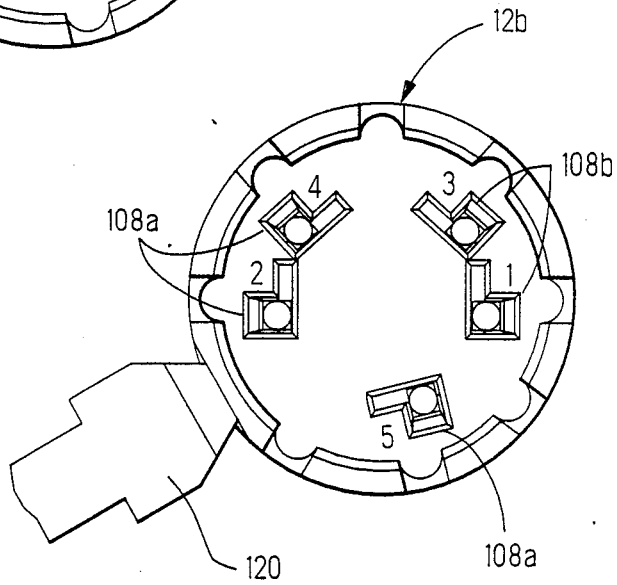
Figure 26:
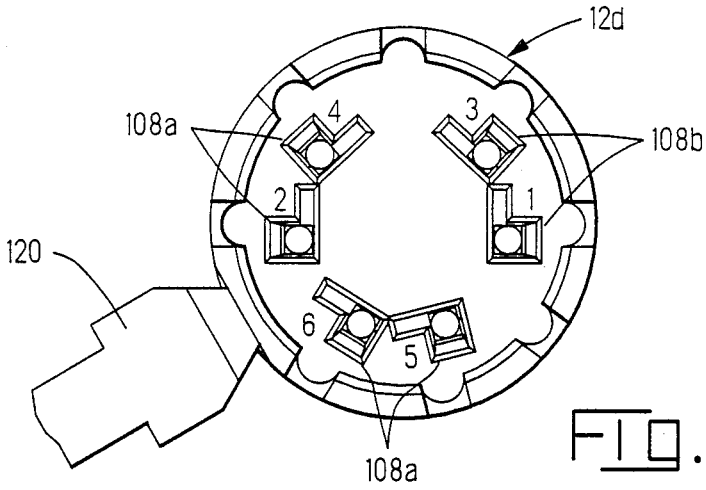

FIGS. 23 to 25 show, in top plan view, respective embodiments 12*a* to 12*d* of the contact housing, having three, four, five and six contact element positions respectively, numbered 1 to 6, respectively, the cavity portions at these positions being referenced as in FIG. 12 and each cavity portion being configured and angled in the same way as a corresponding cavity portion of the housing 12. Thus each of the contact housings 12*a* and 12*d* can be used with the same wire housing 10, the housing 10 to being wired only in the respect of those slots 34 or 34' as the case may be, which correspond to the contact element positions provided in the mating housing 12*a*, 12*b*, 12*c* or 12*d*. The housings 12*a* to 12*d* could be identical, contact elements 42 being loaded only in those cavities that are shown in FIGS. 12*a* to 12*d*, so that only two molds, for the respective housing 12 to 12*d*, need to be tooled.

Figure 31:
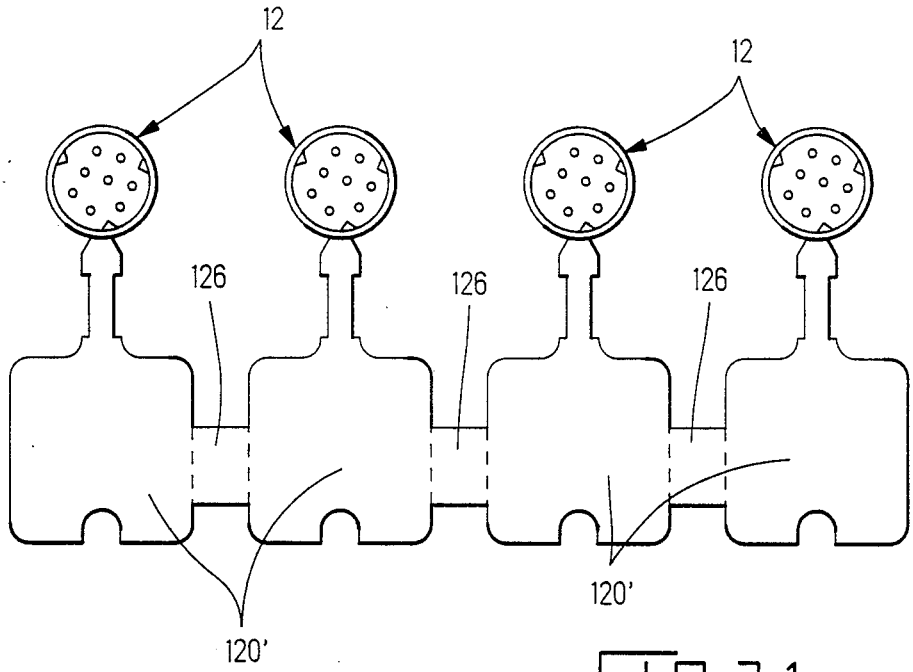
FIGS. 31 and 32 are a front view and a side view, respectively, illustrating a step in the manufacture of a series of the contact housings.
Figure 32:
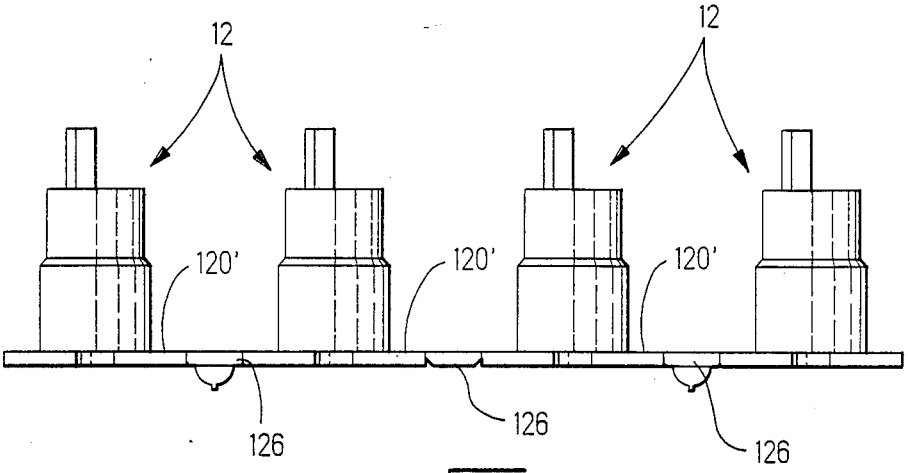

As shown in FIGS. 31 and 32, housings 12 or for that matter housing 10, can be molded in groups of housings, groups of four housings according to the present example, the housings of each group being joined by slugs 126 of the housing material, which connected webs 120' thereof from which the tabs 120 of the housings are subsequently cut.

A practical method of manufacturing the sub-assembly 94 will now be described with reference to FIGS. 35 to 43.

Figure 35:
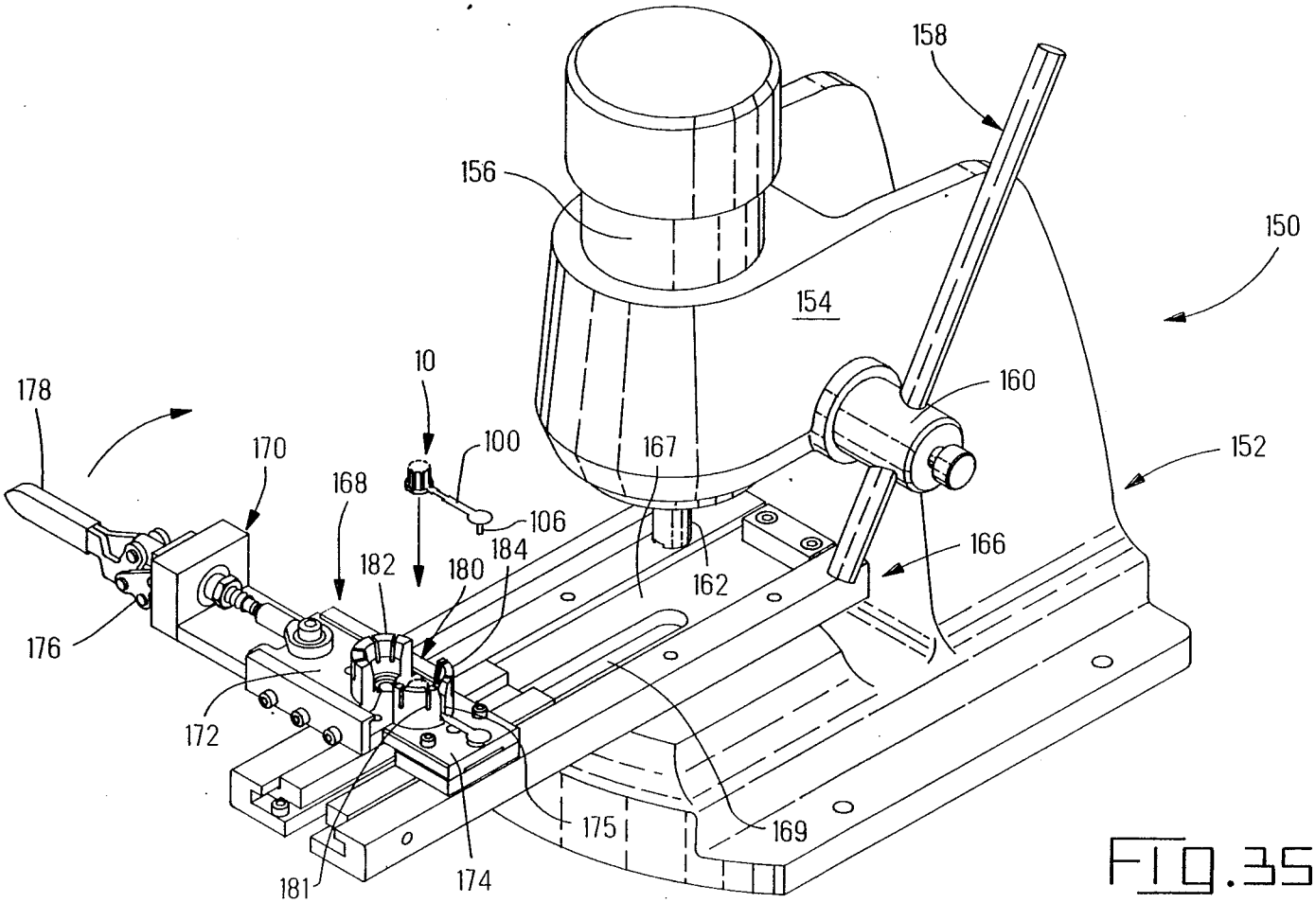
FIGS. 35 to 40 are isometric views illustrating respective steps in a method of manufacturing a sub-assembly of the miniature DIN plug assembly.
Figure 36:
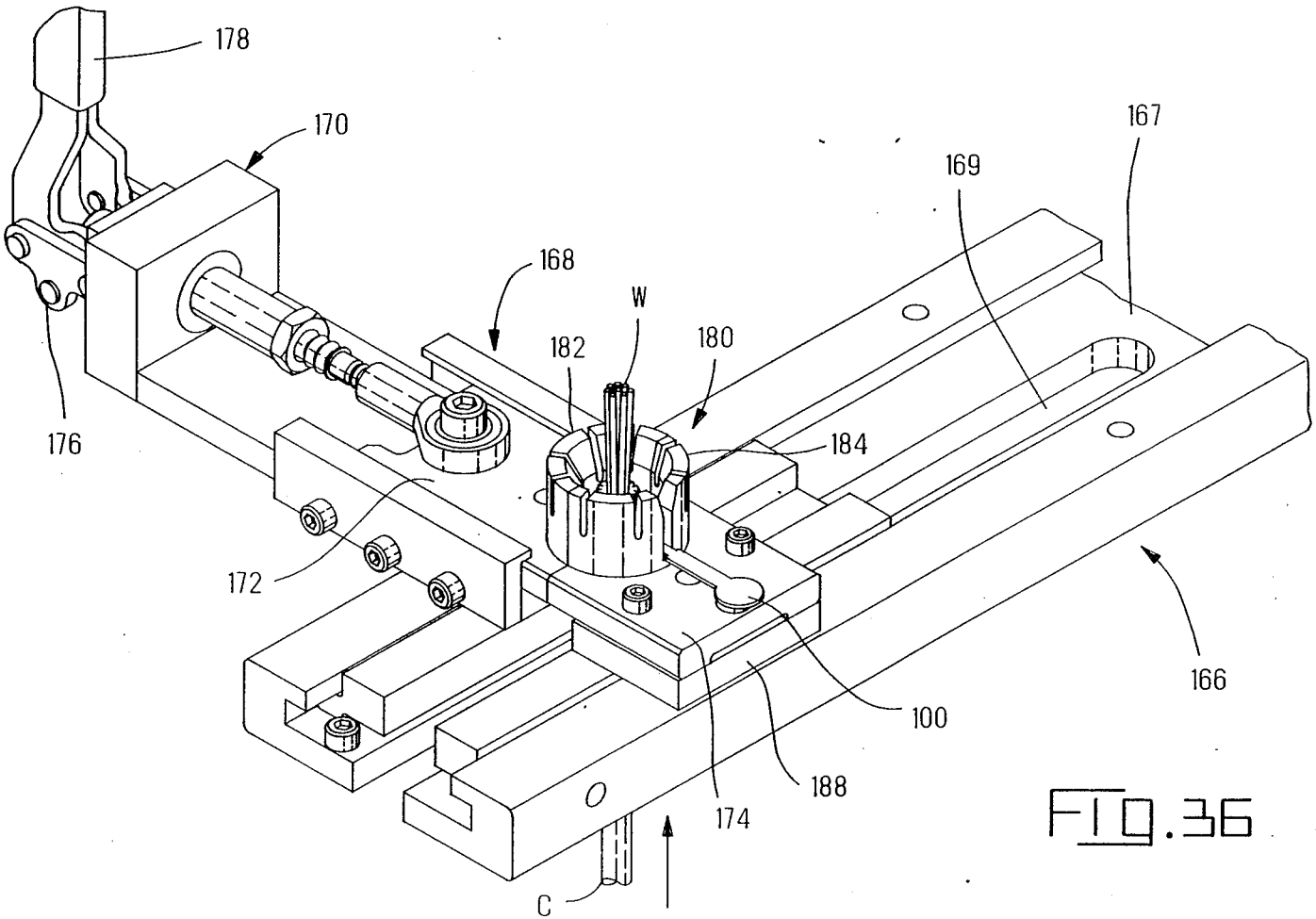
Figure 37:
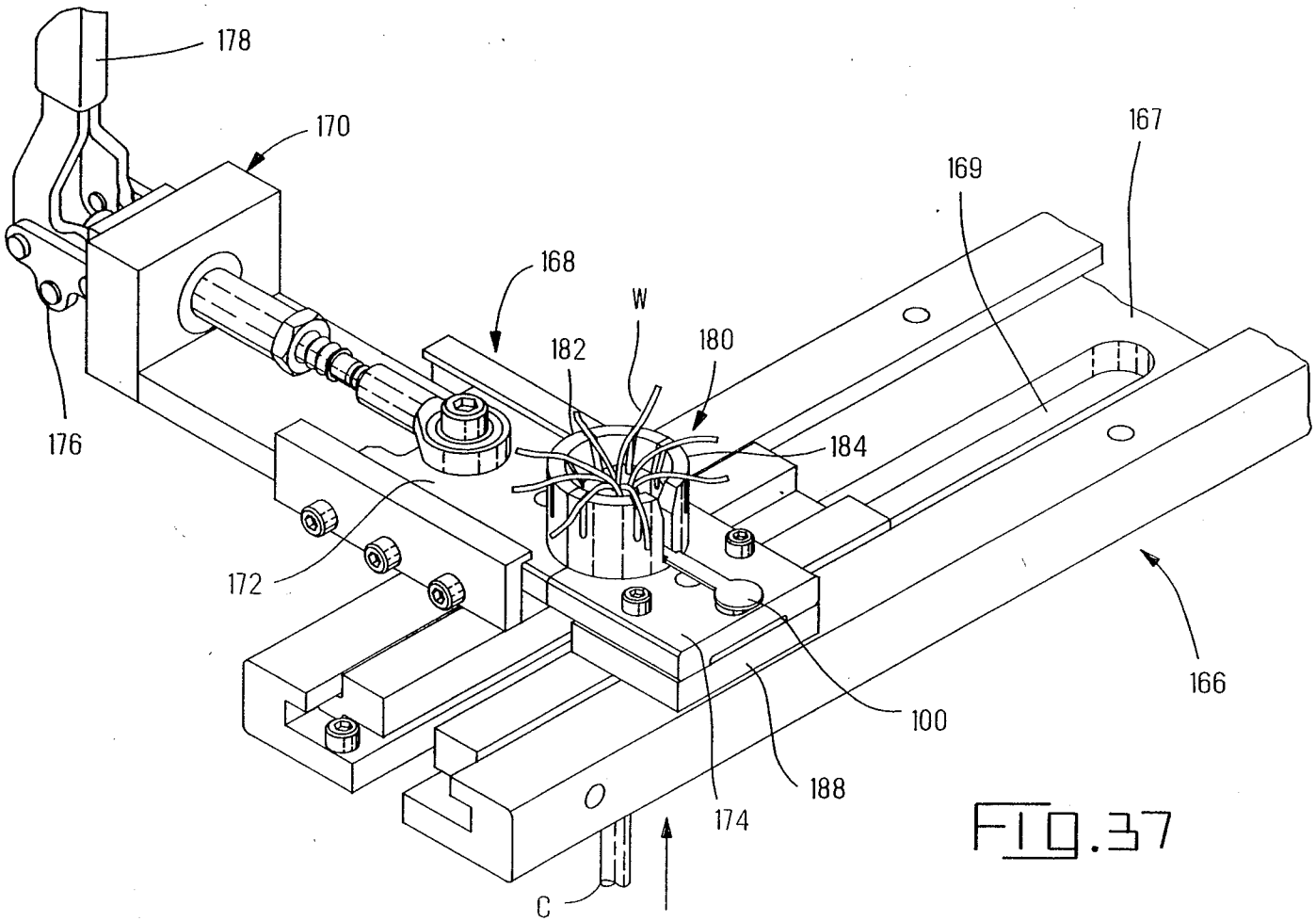
Figure 38:
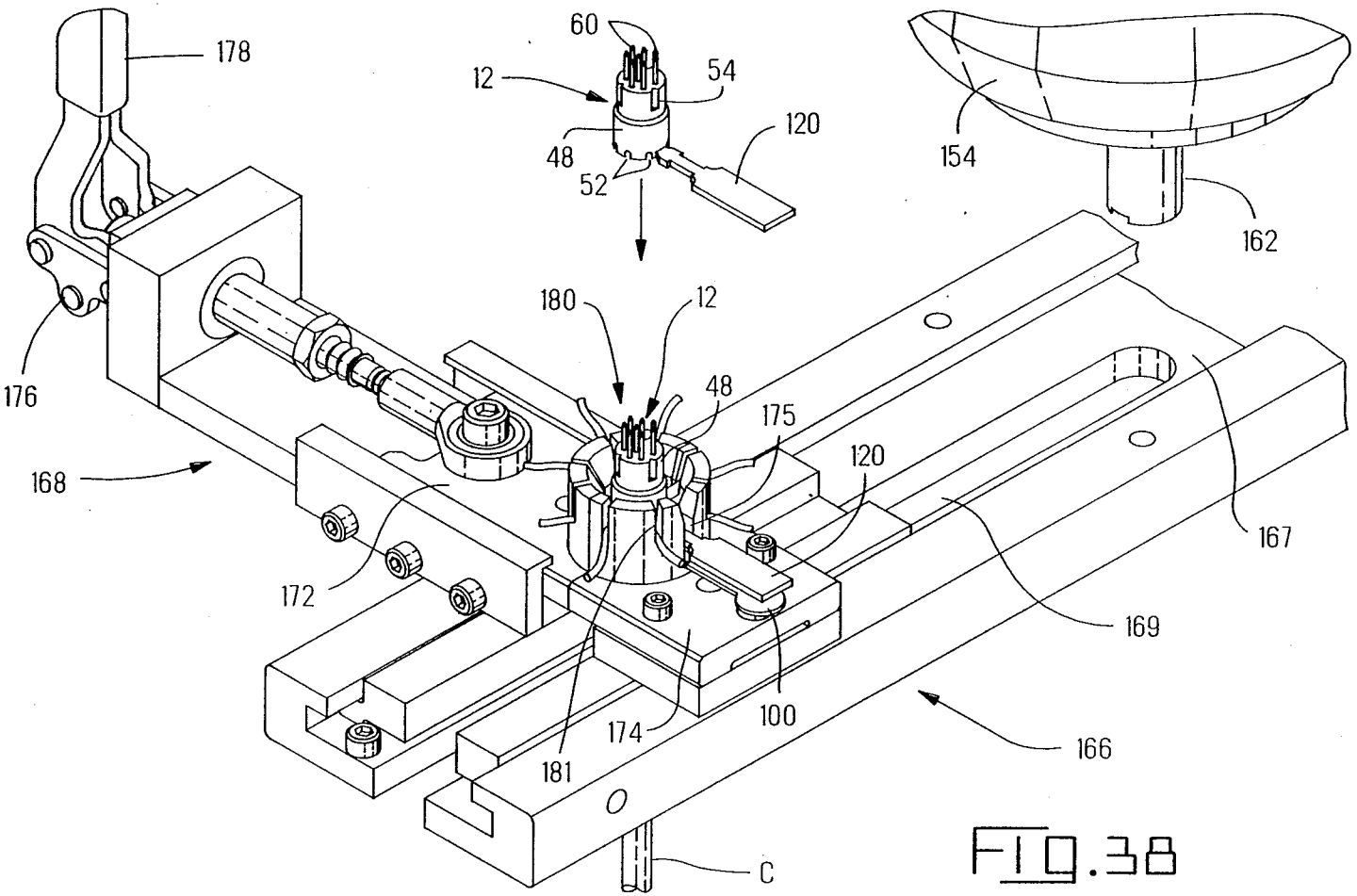
Figure 41:
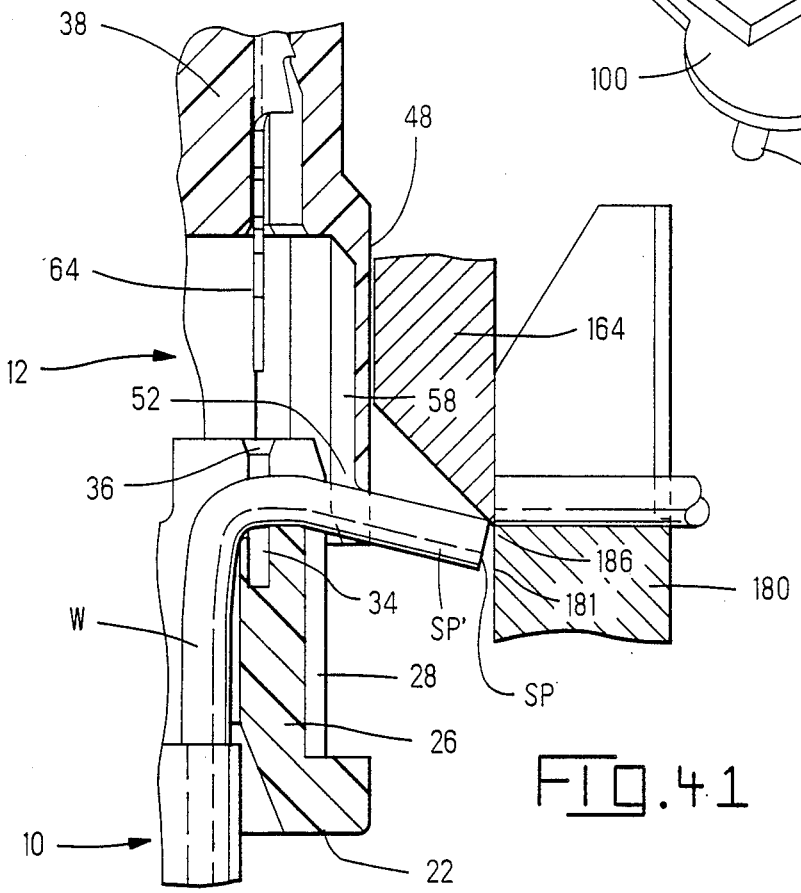
FIGS. 41 to 43 are fragmentary sectional views illustrating some respective steps of said method, in detail.

Briefly stated, the press 150 comprises a frame 152; a ram housing 154; a ram 156 slidable vertically therein; a ram drive handle 158 coupled to the ram 156 by way of a shaft 160 and gear means (not shown); an applicator head 162 on the ram 156; a crown of light shear blades 164 (one of which is shown in FIG. 41) depending from the head 162; a horizontal slideway 166 on the frame 152 having a base 167 formed with a longitudinal through slot 169; a slide 168 which is slidable along the slideway 166; a clamp 170 on the slide 168 having a movable part 172 and fixed part 174; a toggle mechanism 176 having an operating handle 178 for moving the part 132 towards and away from the part 174; and a hinge in the form of a two-part applicator nest 180 having a first half 182 on the part 172 and a second half 184 on the fixed part 174, having a vertical through slot 175. The nest 180 has a ring of light blind slots 181 which open into its upper edge, and the bottom inner edges 182 of which define shear edge 186. With the slide 168 secured at the end of the slideway 155, remote from the ram 166, the ram 166 being in a raised position, and the handle 178 being in a lowered position so that the clamp 170 and the nest 180 are both in an open position as shown in FIG. 35, the operator inserts a wire housing 10 into the open nest 180 by means of the handling tab 100 of the housing 10, the tab 100 being received in the slot 175 of the nest half 184, until the free end of the spigot 106 of the tab 100 engages a horizontal reference surface 188 of the slide 168 (as best seen in FIGS. 36 to 38) so that the housing 10 is correctly oriented and levelled with respect to the open nest 180 so that it is correctly seated therein. The handle 178 is then raised to close the clamp 170 and thus the nest 180. The cable C having been stripped and having its braid shield 135 folded back, as described above, the stripped end of the cable C is inserted from below, up through the slot 169 in the slide 168, so that wires W of cable C project upwardly from the mating face 30 of the housing 10, as shown in FIG. 36, having been guided into the part 18 of the bore 16 by the frusto-conical wall of the mouth 20. In the fully inserted position of the cable C, the end of the braid shield abuts against the stop shoulder 19 between the bore parts 16 and 20. As shown in FIG. 37, each wire end portion is then dressed, in a taut condition, into a respective predetermined notch 32 of the housing 10 so as to extend through a respective blind slot 181 and to bottom therein. As shown in FIG. 41 there is substantial clearance between the nest 180 and the wall 26 of the housing 10.

As shown in FIG. 38, the operator now takes up a housing 12, by its handling tab 120, and orients it above the housing 10 so that the tabs 100 and 120 are in alignment as shown.

The operator then lowers the housing 12 onto the housing 10 so that the wall 26 of the latter is received partially in the hood 48 of the former, the tab 120 of the housing 12 being received in the through slot 175 of the nest 180, thereby ensuring that the tabs 100 and 120 are in precise alignment so that the housings 10 and 12 are correctly angularly oriented with respect to each other (FIG. 38). It must be ensured by means of the levelling spigot 106 that the housings are level, with no noticeable degree of tilt.

Figure 39:
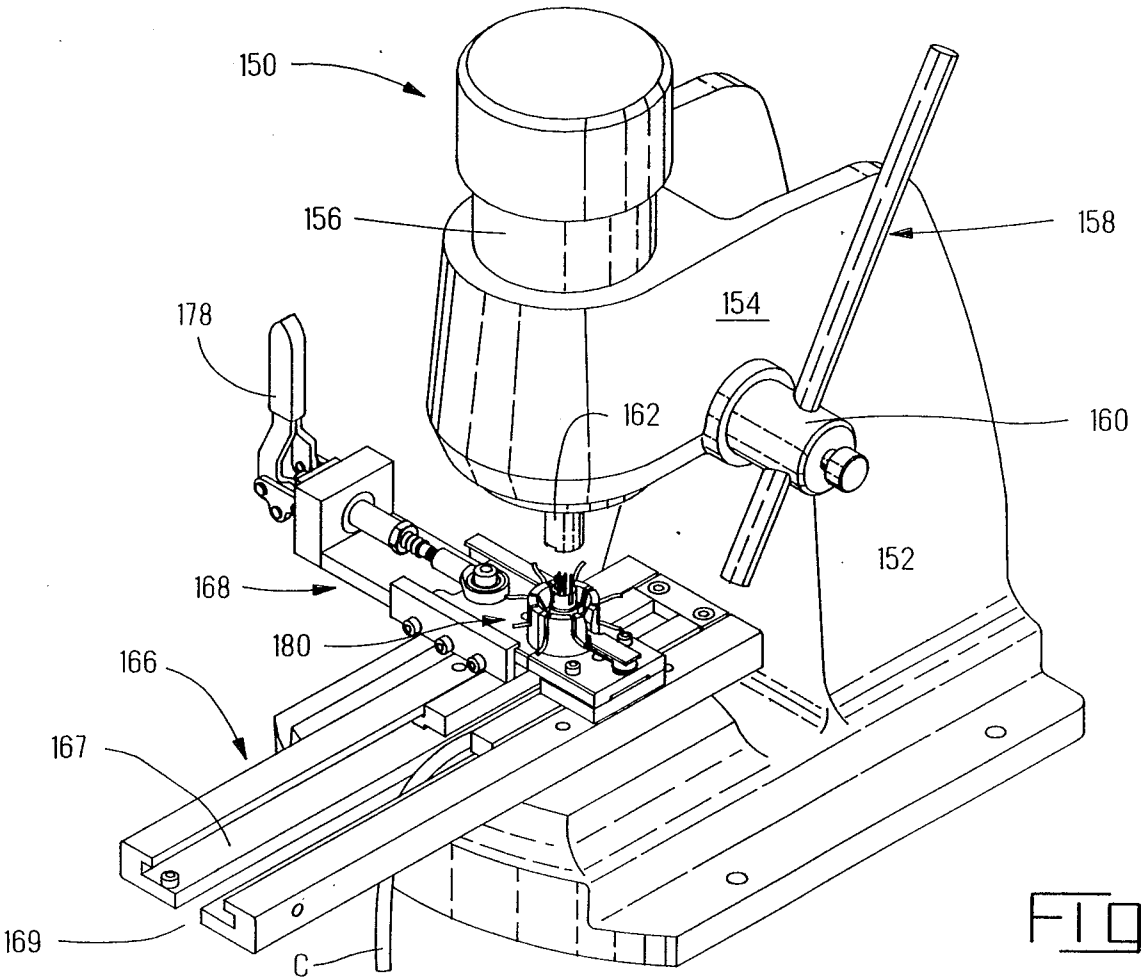
Figure 42:
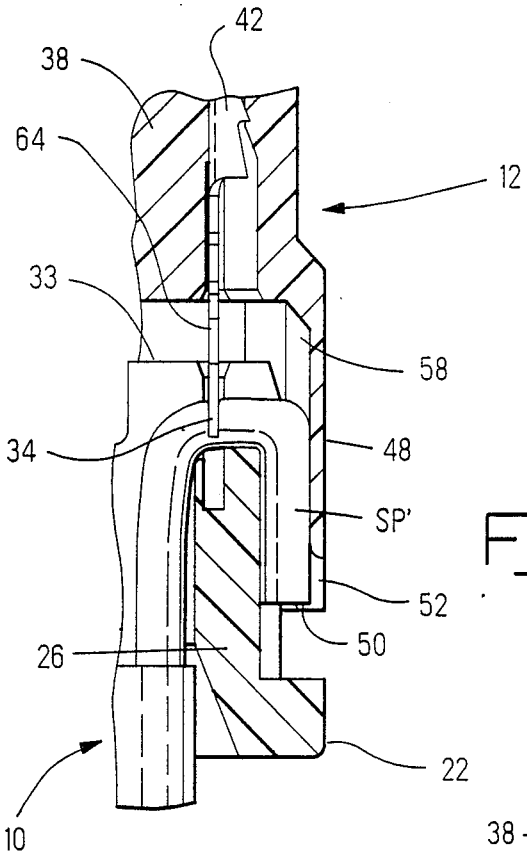
Figure 43:
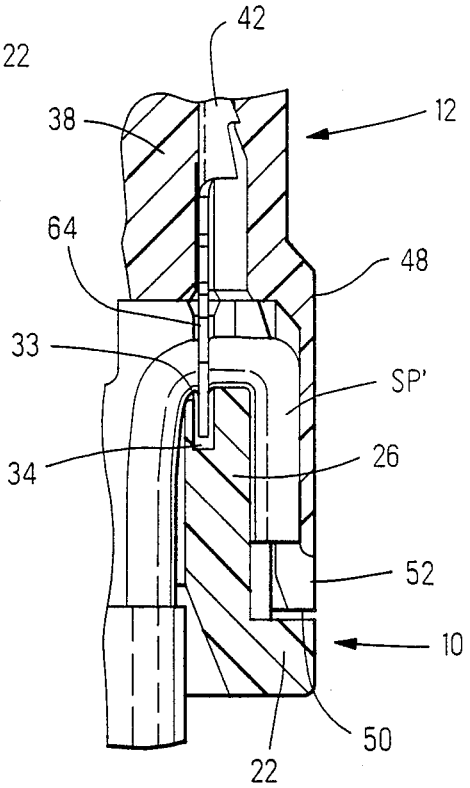

With the housings 10 and 12 so relatively positioned, the slide 168 is advanced by the operator as shown in FIG. 39, towards the ram 156, until the housing 12 lies directly beneath the applicator head 162 when the slide 168 has been arrested by a stop (not shown). The operator then raises the handle 158 so as to depress the ram 156 towards the slide 168 so that each wire 10 is trimmed between a respective shear blade 164 and a respective shear edge 186 as shown in FIG. 41. As the ram 156 advances further, the hood 48 of the housing 12 forces the severed end portion SP' of each wire 10 down into the corresponding groove 28 of the housing 10 and as shown in FIGS. 42 and 43, the severed end portion SP' is fully enclosed in the channel defined by the walls of the grooves 28 and 58. Also, as will be apparent from FIGS. 42 and 43, the wire connecting portion 64 of each contact element is forced through the part of the wire 10 which lies on the base 33 of the respective notch 32, into the part of the slot 34 there beneath, whereby the edges of the slot 66 in the wire connecting portion 64 cut through the insulation of the wire 10 and make permanent electrical contact with the metal core thereof. The edge 50 of the hood 48 bottoms against the collar 22 of the housing 10, when the housing 10 and 12 have been fully assembled to provide the sub-assembly 94. The flats 24 prevent a burr of the housing material from inhibitive complete closure of the tooling about the housing 10.

The operator now depresses the handle 158 thereby raising the ram 156 and retracting the slide 168 to its initial position, lowering the handle 178 to separate the two halves 182 and 184 of the rest 180 and removes the sub-assembly 94 therefrom, by means of the handling tabs 100 and 120.

Figure 40:
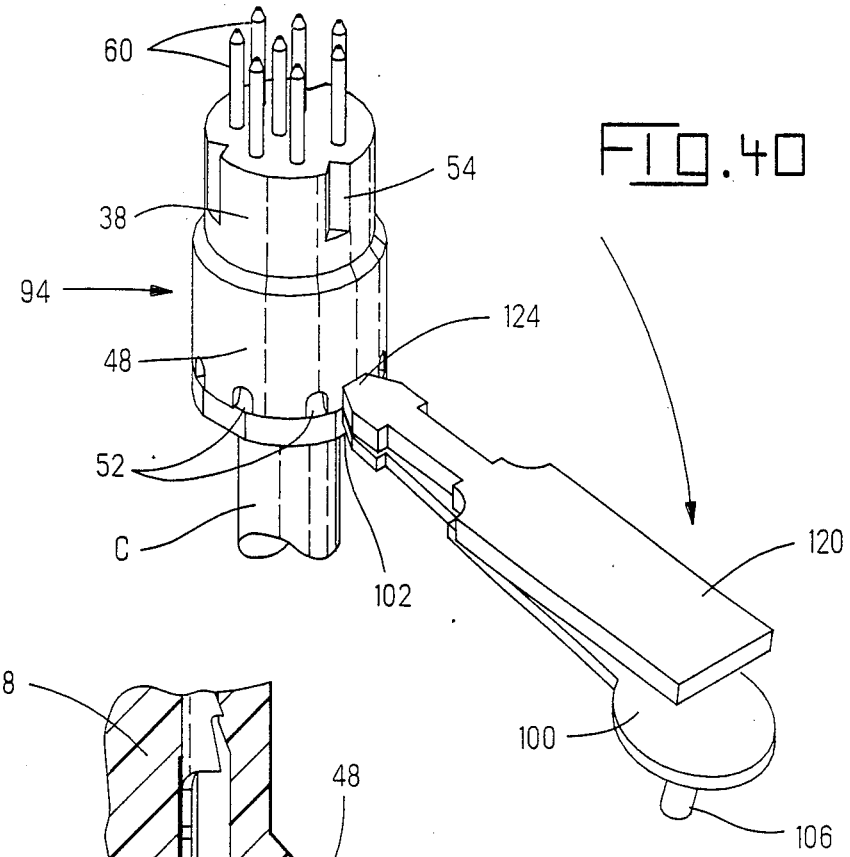

As indicated in FIG. 40, the operator manipulates the handling rams 100 and 120 so as to break them from their respective housings at their respective reduced cross-section portions 102 and 104.

The sub-assembly 94 so stripped of its tabs 100 and 120 is assembled to the shielding shell 14 as described above with reference to FIGS. 5 to 9, or to the shielding shell 14' as described with reference to FIGS. 33 and 34.

While the preferred embodiment has been described with reference to a pin contact, the invention is not limited thereto; a socket or other type of known contact could be used. While the wire housing and contact housings have been described as being held together by the shielding shell, other means for securing the wire and contact housings, such as a resilient latch on one housing riding over a ramp to latch behind a shoulder on the other housing. This would be particularly employed in unshielded connectors which may require a shroud extending from the forward portion of the contact housing.

We claim:

1. A circular cross section electrical connector assembly, comprising:

a tubular, insulating, wire housing defining a central through bore and having a first end formed with a ring of wire receiving notches opening thereinto, each notch having a base and a slot opening thereinto, said housing having a second end opposite to said first end and by way of which a plurality of insulated wires of a shielded electrical cable can be inserted through the bore each for reception in a respective one of said notches;

an insulating contact housing having a first end and a second end opposite thereto, a plurality of through cavities each opening into both of these ends, electrical contact elements secured in the cavities and each having a slotted, wire connection portion projecting from the first end of the contact housing and a mating portion at the other end thereof, the contact housing being matable with the wire housing to provide a sub-assembly in which each wire connecting portion is received in a respective slot of the wire housing to make permanent electrical connection with an insulated wire of said cable when said wire is received in a respective notch of the wire housing; and a open ended tubular metal shielding shell for receiving the whole of said sub-assembly therewithin with the second end of said wire housing proximate to a first end of said shell, said shell having means crimpable over the second end of the wire housing to engage shielding on said cable and means for restraining movement of said assembly towards a second and opposite end of said shell.

2. An assembly as claimed in claim 1, wherein said shielding shell defines an internal peripheral shoulder spaced from said second end thereof said sub-assembly defining a complimentary external peripheral shoulder for engaging against said internal peripheral shoulder.

3. An assembly as claimed in claim 1, wherein said crimpable means comprises a plurality of opposed lugs projecting from the first end of said shell, each lug defining an arcuate inner edge for embracing the shielding of said cable.

4. An assembly as claimed in claim 1, wherein said shell is a seamless, drawn, shielding shell having a portion projecting beyond the second end of the wire housing when said assembly is received in said shell, for crimping about the shielding of said cable so as to enclose the second end of the wire housing.

5. An assembly as claimed in claim 1, wherein said shell has internal keys bent inwardly therefrom said sub-assembly having external keyways for cooperation with said keys to ensure predetermined angular positioning of said shell with respect to said sub-assembly.

6. An assembly as claimed in claim 1, wherein the contact housing comprises a hood projecting from the first end thereof for receiving the wire housing, the hood defining an external shoulder facing the second end of the contact housing, said shell having a larger diameter portion for receiving said hood and a smaller diameter portion for receiving the remainder of the contact housing.

7. An assembly as claimed in claim 1, wherein the wire housing has a collar surrounding said second end thereof and defining an outwardly flared cable and wire guiding mouth of said through bore, for receiving an end portion of the shielding of said cable, said crimpable portion of said shell being crimpable over said collar.

8. A circular cross section electrical connector, comprising:

an insulating tubular, wire housing defining a through bore and having a first end formed with spaced wire receiving notches communicating with slots extending from said first end towards an opposite second end of the wire housing, and end portion of a shielded electrical cable being lodged in said bore proximate to said second end of the wire housing, insulated wires extending from said cable end and through said bore each being lodged in a respective one of said wire receiving notches and extending over a respective slot communicating therewith;

an insulating contact housing supporting therein a plurality of electrical contact elements each having a wire connecting portion projecting from a first end of said contact housing and projecting into a slit of said wire housing in firm electrical contact with a metal core of a respective one of said wires, each contact element having a mating portion projecting from a second and opposite end of said contact housing; and an open ended, tubular metal shielding shell surrounding both of said housings and having a part thereof crimped over the second end of said wire housing and engaging shielding of said shielded cable.

9. A connector as claimed in claim 8, wherein said contact housing comprises a hood receiving said wire housing and defining a plurality of first axial, internal, half channels spaced circumferentially thereof, said wire housing defining a plurality of external wire channels spaced circumferentially thereof, and each being aligned with a respective first half channel to enclose a severed end portion of a respective one of said wires.

10. A connector as claimed in claim 9, wherein said wire housing comprises a collar surrounding said second end thereof a free end of said hood engaging said collar and having a peripheral notch therein in alignment with each of said second half channels.

11. A connector as claimed in claim 8, wherein said crimped part is constituted by an end portion of said shell, which fully encloses said second end of said wire housing.

12. A connector as claimed in claim 8, wherein said crimped part comprises projecting lugs on said shell which have been forced against the cable shielding.

13. A connector as claimed in claim 9, comprising an insulating cover molded about said shell and enclosing said crimped part.

14. A connector as claimed in claim 8, wherein said end portion of said bore is in the form of an outwardly flared mouth, the remainder of said bore being of constant cross section.

* * * * *